US008959683B2

(12) United States Patent
Rochlin

(10) Patent No.: US 8,959,683 B2
(45) Date of Patent: Feb. 24, 2015

(54) WASHABLE PILLOW WITH MULTIPLE CASES

(71) Applicant: Scott Karl Rochlin, Bellevue, WA (US)

(72) Inventor: Scott Karl Rochlin, Bellevue, WA (US)

( * ) Notice: Subject to any disclaimer, the term of this patent is extended or adjusted under 35 U.S.C. 154(b) by 0 days.

(21) Appl. No.: 14/222,381

(22) Filed: Mar. 21, 2014

(65) Prior Publication Data

US 2014/0283303 A1 Sep. 25, 2014

Related U.S. Application Data

(60) Provisional application No. 61/852,919, filed on Mar. 25, 2013.

(51) Int. Cl.
*A47G 9/10* (2006.01)

(52) U.S. Cl.
CPC ..... *A47G 9/10* (2013.01)
USPC ..... 5/640; 5/645; 5/490

(58) Field of Classification Search
CPC ..... A47G 9/10; A47G 9/1045
USPC ..... 5/490, 491, 636, 638–640, 645, 652.1, 5/659
See application file for complete search history.

(56) References Cited

U.S. PATENT DOCUMENTS

| | | | | | |
|---|---|---|---|---|---|
| 3,616,470 | A * | 11/1971 | Young | 5/638 |
| 4,959,880 | A * | 10/1990 | Tesch | 5/636 |
| 5,228,158 | A * | 7/1993 | Park | 5/636 |
| 5,778,470 | A * | 7/1998 | Haider | 5/645 |
| 6,067,679 | A * | 5/2000 | Rice | 5/630 |
| 6,988,286 | B2 * | 1/2006 | Schecter et al. | 5/645 |
| 7,255,917 | B2 * | 8/2007 | Rochlin et al. | 428/304.4 |
| 7,461,424 | B2 * | 12/2008 | Lindell | 5/655.9 |
| 7,530,127 | B2 * | 5/2009 | Leifermann et al. | 5/636 |
| 2014/0082846 | A1 * | 3/2014 | Blazar | 5/645 |

* cited by examiner

*Primary Examiner* — Michael Trettel
(74) *Attorney, Agent, or Firm* — John W. Branch; Lowe Graham Jones PLLC

(57) ABSTRACT

Embodiments are directed towards a pillow with a removable core that includes a plurality of cut foam pieces of various or similar shapes/sizes. The pillow may include an outer shell case and an inner shell case (i.e., the removable core). The outer shell case may be made of a plurality of layers, including a backing layer positioned between an external layer and an internal layer. The backing layer may comprise a foam material. And the internal layer and the inner shell case may comprise an open mesh material. The inner shell case may be removably inserted into the outer shell case. A plurality of foam pieces may be disposed inside the inner shell case.

11 Claims, 19 Drawing Sheets

WASHABLE PILLOW WITH MULTIPLE CASES

CROSS-REFERENCE TO RELATED APPLICATIONS

This Utility Patent Application claims the benefit under 35 U.S.C. §119(e) of U.S. Provisional Patent Application Ser. No. 61/852,919 filed on Mar. 25, 2013, which is incorporated herein by reference.

TECHNICAL FIELD

The present invention relates generally to pillows and more particularly, but not exclusively, to pillows that include an outer shell case with a polyurethane foam backing and an inner shell case that includes a plurality of foam pieces cut into similar or various sizes.

BACKGROUND

Today, people use many different types of pillows to try and get a good night's sleep. These various types of pillows employ different materials, textures, and comfort levels to account for variations in what people prefer in a pillow. But nearly all pillows have one thing in common, microorganism growth and allergen accumulation.

Many pillow makers have concentrated on comfort as a leading factor in developing pillows, rather than managing microorganism growth. One technique for managing pillow microorganisms is to have the pillow cleaned. However, current pillow designs are often difficult to clean, which results in un-effective microorganism management. Some pillow designs make claims of being washable in conventional washing machines. Unfortunately, most of these previous washable pillows suffer from similar problems, such as: 1) unable to effectively get hot water and air to penetrate to the core of the pillow in such a manner to kill the bacteria and molds, while giving comfort and quality that is essential to sleep; 2) failing to allow a pillow to wash and dry quick enough to finish in one cycle; 3) requiring the use two pillows to balance a washing machine, or the use other items (e.g., tennis balls) to beat the pillow clean; and 4) only partially drying the center of the pillow.

Often, pillows with regular polyester, feathers, and/or down fill are difficult to dry, let alone wash. Similarly, pillow cases made out of higher density materials (e.g., 300, 200 or 100 count cotton, synthetic, blended, or other tightly woven materials) typically hamper the penetratability of water and air to the center of the pillow.

Some companies have turned to chemicals along with various materials to try and solve some of the problems with washing pillows. However, these chemicals/materials have a tendency to settle and make the pillow uncomfortable. Also, some companies have tried to make pillows having foam materials with washable cases. But many times the foam can only be spot cleaned or dry cleaned. Yet other products that are made of plastics can be brittle, and often do not have the right combination of cushion, conformability, shape adjustability, and high quality cleaning capability. Previously, the predominant outlook of pillow cleaning has been that pillows can only be cleaned on the surface and not deep inside. What is needed is a pillow which offers superior cushioning, form fit, overall shape and support, is easy to thoroughly clean, and the ability of the user to reach inside the core to really feel that it dry. Thus, it is with respect to these and other considerations that the invention has been made.

BRIEF DESCRIPTION OF THE DRAWINGS

Non-limiting and non-exhaustive embodiments are described with reference to the following drawings. In the drawings, like reference numerals refer to like parts throughout the various figures unless otherwise specified.

For a better understanding of the present invention, reference will be made to the following Detailed Description, which is to be read in association with the accompanying drawings, wherein.

DETAILED DESCRIPTION

Figure 1:
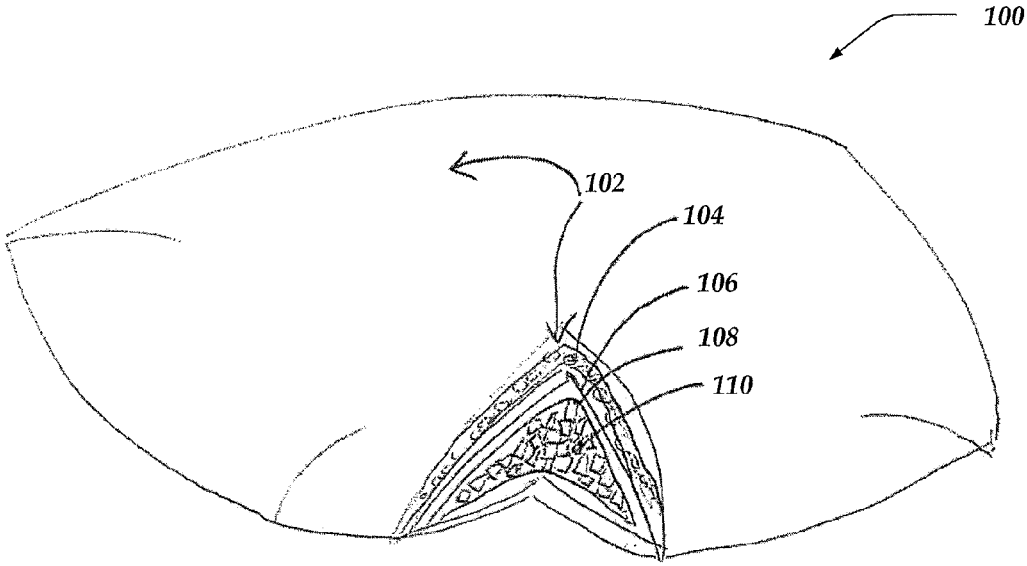
FIG. 1 shows a schematic perspective view with a cutout of an embodiment of a pillow in accordance with at least one of the various embodiments.

Various embodiments are described more fully hereinafter with reference to the accompanying drawings, which form a part hereof, and which show, by way of illustration, specific aspects and embodiments by which the invention may be practiced. These embodiments are described in sufficient detail to enable those skilled in the art to practice the present subject matter of the invention. It will be apparent, however, to one skilled in the art that the various embodiments may be practiced without some of these specific details or with additional details not shown. The embodiments may be embodied in many different forms and should not be construed as limited to the embodiments set forth herein; rather, these embodiments are provided so that this disclosure will be thorough and complete, and will fully convey the scope of the embodiments to those skilled in the art. Among other things, the various embodiments may be methods, systems, or apparatuses. The following detailed description should, therefore, not be limiting.

Throughout the specification and claims, the following terms take the meanings explicitly associated herein, unless the context clearly dictates otherwise. The term "herein" refers to the specification, claims, and drawings associated with the current application. The phrase "in one embodiment" as used herein does not necessarily refer to the same embodiment, though it may. Furthermore, the phrase "in another embodiment" as used herein does not necessarily refer to a different embodiment, although it may. Thus, as described below, various embodiments of the invention may be readily combined, without departing from the scope or spirit of the invention. The following detailed description is, therefore, not to be taken in a limiting sense, and the scope is defined only by the appended claims, along with the full scope of legal equivalents to which such claims are entitled.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

The following briefly describes embodiments of the invention in order to provide a basic understanding of some aspects of the invention. This brief description is not intended as an extensive overview. It is not intended to identify key or critical elements, or to delineate or otherwise narrow the scope. Its purpose is merely to present some concepts in a simplified form as a prelude to the more detailed description that is presented later.

Briefly stated, various embodiments are directed to a pillow with a removable core that includes a plurality of cut foam pieces of various or similar size. The pillow may include an outer shell case and an inner shell case (i.e., the removable core). The outer shell case may be made of a plurality of layers, including a backing layer positioned between an external layer and an internal layer. In some embodiments, the internal layer may comprise an open mesh material and the backing layer may comprise a foam material. The inner shell case may be removably inserted into the outer shell case and the inner shell case may comprise another open mesh material. In some embodiments, the inner shell case and the internal layer of the outer shell case can be made of the same material (e.g., nylon or polyester). Also, a plurality of foam pieces may be disposed in the inner shell case. In some embodiments, the foam pieces may be made of same or different foam as the backing layer f the outer shell case. In various embodiments, the plurality of foam pieces may be sharply cut polyurethane foam. The foam pieces may be of similar of different sizes and may be of any similar or different shapes (e.g., rectangular/bar-shaped, square/cubic, elongated, triangular/pyramidal, parallelepiped, spherical, half-hemispheres, trapezoidal, tubes/cylindrical, conical, any other regular or non-regular three-dimensional shapes, or any combination thereof, and may be solid, hollow, perforated, or any combination thereof.).

In some embodiments, the outer shell case may include a first sleeve, a second sleeve, and a bridge that together form a u-shape (the bridge may be positioned between the first and second sleeves to create the base of the "u"). A plurality of inner shell cases may be inserted into the outer shell case. For example, a first inner shell case and a second inner shell case may be formed (e.g., by rolling) into separate cylindrical-like shapes forming a first end and a second end. In various embodiments, the second inner shell case may be longer than the first inner shell case (but in other embodiments, both inner shell cases may be of similar lengths). The first inner shell case may be removably inserted into the outer shell case such that the first end of the first inner shell case may be positioned within the first sleeve and the second end of the first inner shell case may extend into the bridge. Similarly, the second inner shell case may be removably inserted into the outer shell case such that the first end of the second inner shell case may be positioned within the second sleeve and the second end of the second inner shell case may be flexed across the bridge to abut the first inner shell case. In various embodiments, the outer shell case may be a protective case and the inner cases inserted into the sleeves of the protective case may be complete pillows that employ embodiments described herein—e.g., each separate inner case may include an outer shell case (that includes at least three layers) and a removable inner shell case (that includes a plurality of foam pieces).

General Description

FIG. 1 shows a schematic perspective view with a cutout of an embodiment of a pillow in accordance with at least one of the various embodiments. Pillow 100 may include an outer shell case and an inner shell case (case 108). The outer shell case can include external layer 102, backing layer 104, and internal layer 106. Inner shell case 108 may include a plurality of foam pieces 110 disposed therein. These various components are described in more detail herein.

Figure 2:
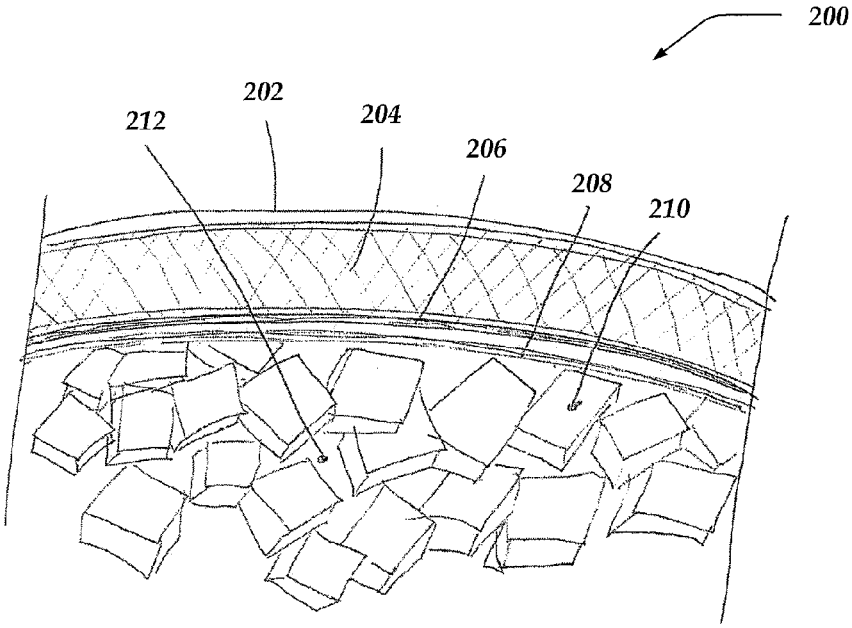
FIG. 2 shows a schematic cross-sectional view of an embodiment of a pillow in accordance with at least one of the various embodiments.

FIG. 2 shows a schematic cross-sectional view of an embodiment of a pillow in accordance with at least one of the various embodiments. Pillow 200 may be an embodiment of pillow 100 of FIG. 1 and may include an outer shell case and an inner shell case. In some embodiments, these casing may also be referred to as an exterior shell casing and an interior shell casing, respectively.

The outer shell case can include external layer 202, backing layer 204, and internal layer 206. Inner shell case 208 may include a plurality of foam pieces 210 disposed therein with open spaces 212 between the foam pieces.

The outer shell case may include multiple layers, such as external layer 202, backing layer 204, and internal layer 206. In some embodiments, external layer 202 of the outer shell case may be made of nylon, polyester, or other open mesh material. External layer 202 may be sewn together with backing layer 204 and/or internal layer 206, such that backing layer 204 is between external layer 202 and internal layer 206, and that internal layer 206 is composed on the inside of the outer shell case and positioned between backing layer 204 of the outer shell case and inner shell case 208.

In various embodiments, external layer 202 may be made of material that may include perforations on the exterior of the case, which may be visible to the human eye (and not microscopic). Measurements of these perforations may vary from approximately 0.0254 millimeter to approximately 5.08 millimeter (or approximately 0.001 inches to 0.2 inches) in diameter (larger or smaller) depending the material of external layer 202 and/or equipment used to make the material. In various embodiments, the perforations may look patterned. The patterned perforations may include round holes, square holes, or other shapes. In at least one embodiment, the holes in the patterned perforations may be consistent with one another. In some embodiments, these perforations may increase water and air penetration into backing layer 204 and/or into inner shell case 208, which can increase the effectiveness of washing/drying cycles of a washing machine or dryer.

In at least one of various embodiments, backing layer 204 may be of similar thickness and/or similar density throughout. In some embodiments, backing layer 204 may be a cushion, which may be made of polyurethane foam. In some embodiments, the foam used as backing layer 204 may be open cell or completely open cell without membranes. Backing layer 204 may have a thickness between approximately 3.175 millimeters and 25.4 millimeters (or approximately 0.125 inches and 1.0 inches), but thinner or thicker foams or cushion materials may be used. In some embodiments, backing layer 204 may be made of a same or similar foam and/or same or similar thickness as foam pieces 210 included inside inner shell case 208, described herein.

In some embodiments, internal layer 206 of the outer shell case can be made of a mesh material with similar holes range from approximately 0.254 millimeter to 6.35 millimeters (or approximately 0.01 to 0.25 inches). This internal layer may be sewn (or otherwise attached) to backing layer 204 and/or external layer 202 such that the internal layer is inside of the outer shell case. This mesh can allow more thorough washing and drying of the foam backing layer. In some embodiments, internal layer 206 may be made of the same material as inner shell case 208.

The outer shell case, and in particular, backing layer 204, may provide many advantages. For example, it may hide the lumps caused by the plurality of foam pieces 210 inside inner shell case 208. Also, the outer shell case can allow inner shell case 208 to maintain a firmer embodiment than without a surrounding case. Another reason behind the outer shell case is aesthetic appeal. Many users appreciate and want an eye appealing look on their beds. If the outer shell case is too thin, or not at all there, lumps may be readily visible, which can be annoying to some users. Backing layer 204 can also aide in the equal dispersion of foam pieces inside inner shell case 208. In some situations, the outer shell case can act as a balancer or equalizer to the mesh filled inner shell case. Because foam typically contains static electricity, and is usually more jagged than smooth under the microscope, small separate dispersed pieces can be held in position better with a counter balance of foam backing layer of the outer shell case than with a thin casing as used in most pillows.

Figure 7:
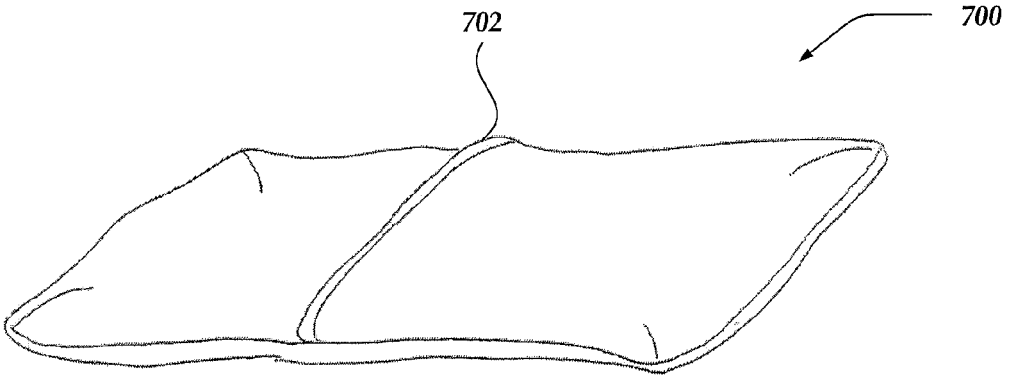
FIG. 7 shows a schematic perspective view of an embodiment of a pillow's outer shell case without the inner shell case in accordance with at least one of the various embodiments.
Figure 9:
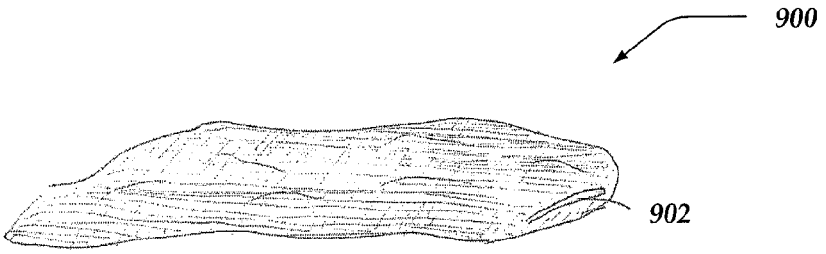
FIG. 9 shows a schematic perspective view of an embodiment of a pillow's inner shell case filled with foam pieces without the outer shell case in accordance with at least one of the various embodiments.

In some embodiments, the outer shell case may include an aperture from width to width across the body of the pillow, which is further illustrated in FIGS. 7 and 9.

Inner shell case 208 may include a cavity that can hold a plurality of foam pieces 210 disposed inside inner shell case 208. In at least one of various embodiments, inner shell case 208 may be stitched or otherwise closed in an arrangement that prevents foam pieces 210 from being removed from or falling out of inner shell case 208. In other embodiments, inner shell case 208 may include an access passage that can allow a user and/or manufacturer to add or remove foam pieces or so the user can feel if the foam pieces are dry after washing. Such an access passage may include a zipper, buttons, Velcro, or other fastener, which is further illustrated below in conjunction with FIG. 9.

In various embodiments, inner shell case 208 may be made of a mesh material. Examples of such mesh material may include, but are not limited to, nylon, polyester, or similar material. In at least one of various embodiments, the mesh material of the inner shell case may include a plurality of holes. In some embodiments, these holes may be greater than a size of most cotton sheets, but not large enough that foam pieces 210 can fall completely through inner shell case 208. In some embodiments, inner shell case 208 may be made of the same material that is used as internal layer 206 of the outer shell case.

In some embodiments, the various components of the pillow may be made of, include, or treated with hypoallergenic materials (e.g., to remove grasses or other pollens). In at least one such embodiment, the inner shell case and/or the outer shell case may include hypoallergenic materials. Some embodiments may include a hypoallergenic assembly of the casings and filling (e.g., the plurality of foam pieces). Similarly, some embodiments may include a hypoallergenic assembly of casings, the foam backing (e.g., backing layer 204), and other pillow features not described herein.

In other embodiments, the various components (e.g., materials/fabrics/foams) used to make the outer shell case, the inner shell case, and/or the foam pieces may be manufactured and/or treated with various healthful properties, e.g., anti-bacterial, anti-mold, anti-allergen, or the like. In some embodiments, the various pillow components may be treated after they are made—e.g., coating them with a chemical, pesticide, or other compound—which may provide some of these healthful properties. In other embodiments, the pillow components may be manufactured with chemicals and/or compounds such that the healthful properties are directly built in. However, embodiments are not so limited and other methods and/or treatments may be utilized to provide additional healthful properties to the various pillow materials, fabrics, and/or foams.

As described herein, a plurality of foam pieces 210 may be disbursed inside inner shell case 208 of the pillow. The spaces 212 between foam pieces 210 can allow air to continually pass through the pillow keeping the pillow cool and dry. Similarly, these spaces 212 can allow hot water to pass easily through the pillow and in essence enable cleaning and/or scrubbing of the core of the pillow.

In some embodiments, the plurality of foam pieces 210 may be made from various types of foam with various different properties, some of which are described in more detail below in conjunction with FIGS. 24 and 25. Similarly, various machines and/or processes may be employed to obtain foam pieces of a selected size and/or shape, in which one embodiment is described in more detail below in conjunction with FIGS. 26A-26D.

In at least one of the various embodiments, the plurality of foam pieces 210 may be formed or otherwise cut in similar or different shapes. In various embodiments, the plurality of foam pieces 210 may be of various shapes, including regular and/or irregular shapes. For example, foam pieces 210 may be rectangular/bar-shaped, square/cubic, elongated, triangular/pyramidal, parallelepiped, spherical, half-hemispherical, trapezoidal, tubes/cylindrical, conical, and any other regular or non-regular three-dimensional shapes, or any combination thereof. In various embodiments, the foam pieces may be solid, hollow, perforated, or the like, or any combination thereof.

In various embodiments, foam pieces 210 may be of similar sizes. In some embodiments, each of the plurality of foam pieces 210 may have an average thickness of approximately 5.08 millimeters to 76.2 millimeters (or approximately 0.2 to 3 inches). However, embodiments are not so limited and other sizes/shapes may be employed. For example, in some embodiments, the plurality foam pieces may be rectangular with lengths between approximately 5.08 millimeters to 76.2 millimeters (or approximately 0.2 inches to 3 inches). In other embodiments, the plurality of foam pieces may be square (or cubic), ranging in size between approximately 6.35 millimeters to 76.2 millimeters (or approximately 0.25 inches to 3 inches) in height. In yet other embodiments, the plurality of foam pieces may have an elongation percentage of 90 to 110 percent. However, embodiments are not so limited and other sizes and/or variances in size may also be employed. In at least one of various embodiments, the sizes of the plurality of foam pieces may be selected such that they have similar group densities. In at least one embodiment, the size of foam pieces 210 may be selected based on their equal dispersion of density. For example, in some embodiments, three different sizes (and/or shapes) of foam pieces may be used such that ⅓ of the plurality of foam pieces may be a first size, ⅓ of the plurality of foam pieces may be a second size, and ⅓ of the plurality of foam pieces may be a third size (although other numbers of different sizes and/or shapes may be used in various other proportions).

The size and shapes of the foam pieces 210 may be selected by engineering judgment such that the plurality of foam pieces may be similar enough to randomly work together as pillow fill to substantially similar density throughout the pillow and to not create a lopsided pillow, while being large enough to be contained by inner shell case 208. In some embodiments, the size of the foam pieces may be selected for their average size, and the selected group may adhere to a selected standard deviation of size. In at least one such embodiment, a standard deviation of sizes for each foam size group may be selected to achieve a beneficial interrelationship between the foam pieces. In some embodiments, the foam pieces may be selected such that when combined into groups, a group of 100 pieces (or other suitable number of pieces) may be of similar density as a different group of 100 pieces, even though a size of each foam piece can vary approximately 5.08 millimeters to approximately 76.2 millimeters (or approximately 0.2 inch to approximately 3 inches). In at least one embodiment, one size may be used for maximum comfort and dispersion throughout the pillow. In any event, embodiments are not limited to foam pieces of a particular size or of a particular average size, and other sizes of foam pieces than what is described herein may be used within the present scope. Additionally, it is envisaged that various sizes and/or shapes of the plurality of foam pieces may be employed in various different ratios for different embodiments.

In yet other embodiments, the plurality of foam pieces 210 may be of any die cut solid shape, but not Frayed so that small particles can escape through the mesh material of the inner shell case. For example, in at least one of various embodiments, the plurality of foam pieces may be sharply cut to minimize foam crumbs from inside the pillow. In other embodiments, the plurality of foam pieces may be decisively precision cut as to leave zero (or almost zero) flaking of foam. In yet other embodiments, the plurality of foam pieces may be formed such that they leave zero residual foam (or predominantly zero) pieces that can escape through the mesh of the inner shell case. It should be recognized that other sizes and/or shapes of the foam pieces may vary depending on the size and/or shape of the pillow; the give, compressibility, or softness of a desired pillow; or the like.

Figure 3:
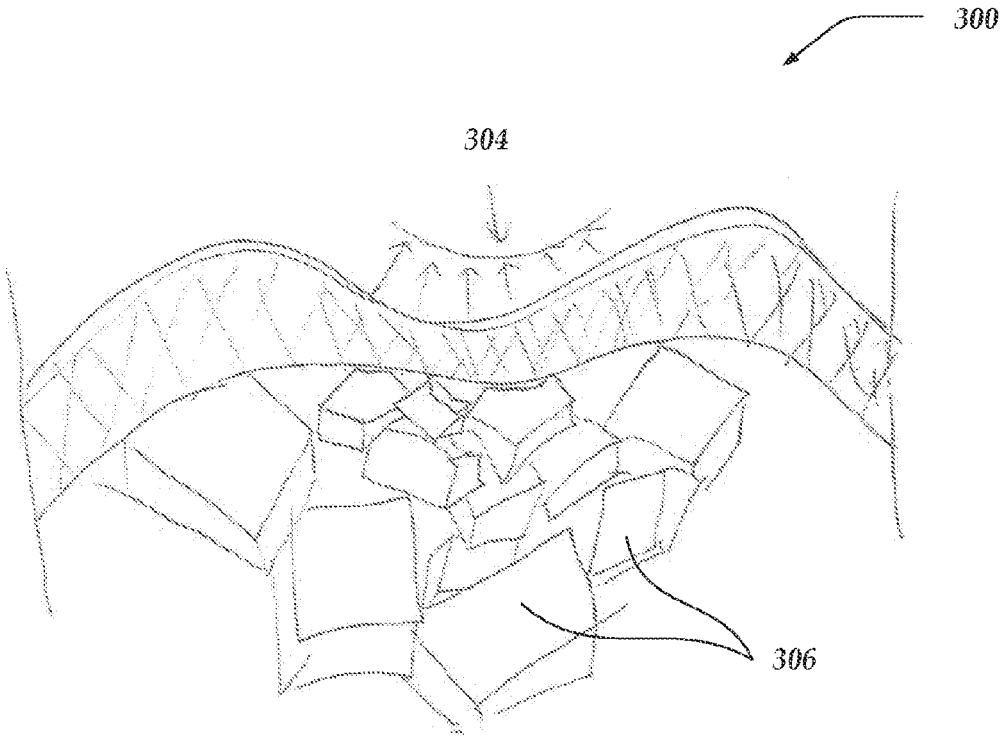
FIG. 3 shows a schematic cross-sectional view of an embodiment of a pillow with a weight of a head or similar) in accordance with at least one of the various embodiments.

FIG. 3 shows a schematic cross-sectional view of an embodiment of a pillow with a weight of a head or other object in accordance with at least one of the various embodiments. Pillow 300 may be an embodiment of pillow 200 of FIG. 2. Force 304 may simulate a head or other object resting on pillow 300, which can compress at least a portion of foam pieces 306 (which may be embodiments of foam pieces 210 of FIG. 2).

Figure 4:
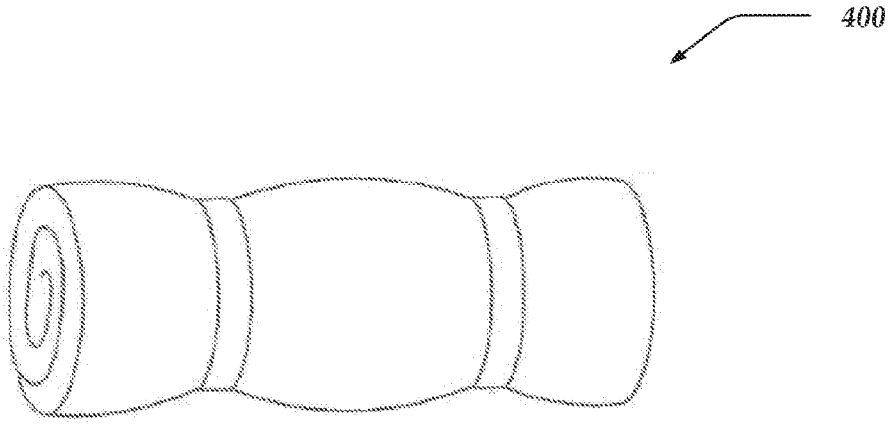
FIG. 4 shows a schematic perspective view of an embodiment of a pillow rolled in accordance with at least one of the various embodiments.

FIG. 4 shows a schematic perspective view of an embodiment of a pillow rolled in accordance with at least one of the various embodiments. Pillow 400 may be an embodiment of pillow 200 of FIG. 2, but rolled up to illustrated the compressibility of pillow 400.

Figure 5:
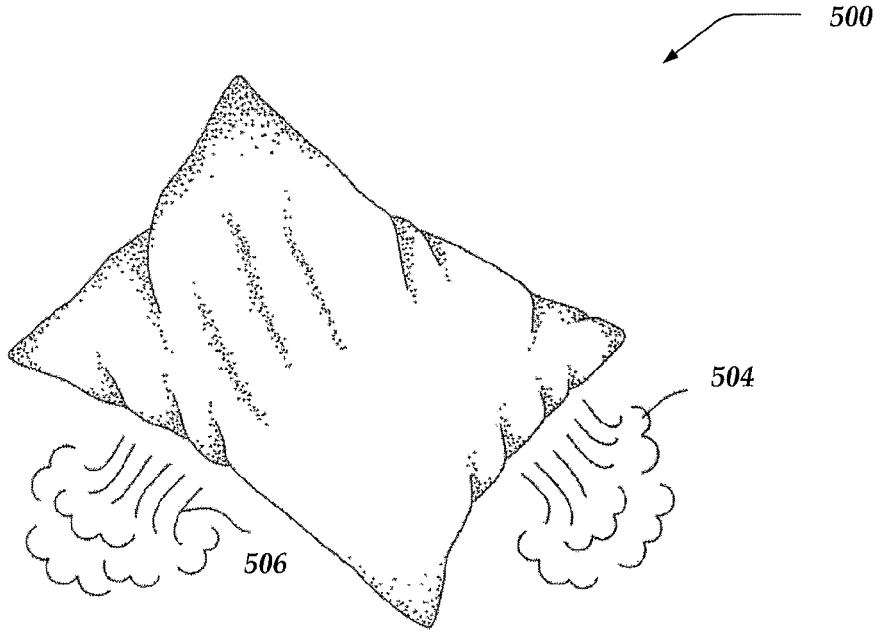
FIG. 5 shows a schematic top view of an embodiment of a pillow with air passing through it in accordance with at least one of the various embodiments.

FIG. 5 shows a schematic top view of an embodiment of a pillow with air passing through it in accordance with at least one of the various embodiments. Pillow 500 may be an embodiment of pillow 200 of FIG. 2. As illustrated and described herein, air may flow through pillow 500, which is indicated by air 504 and 506 exiting the pillow.

Figure 6:
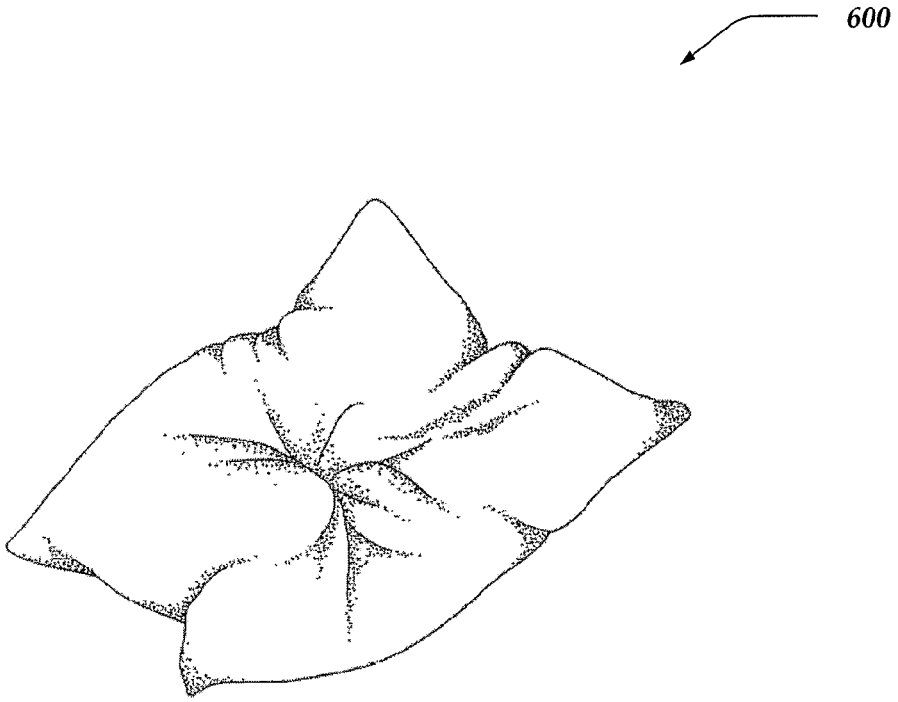
FIG. 6 shows a schematic top view of an embodiment of a pillow in a cushioned position for the flexibility in accordance with at least one of the various embodiments.

FIG. 6 shows a schematic top view of an embodiment of a pillow in a cushioned position for the flexibility in accordance with at least one of the various embodiments. Pillow 600 may be an embodiment of pillow 200 of FIG. 2.

FIG. 7 shows a schematic perspective view of an embodiment of a pillow's outer shell case without the inner shell case in accordance with at least one of the various embodiments. Outer shell case 700 may be an embodiment of the outer shell case described in FIG. 2. Outer shell case 700 may include aperture 702.

In some embodiments, aperture 702 can allow the removal of the inner shell case (e.g., inner shell case 208 of FIG. 2 and/or inner shell case 900 of FIG. 9) from outer shell case 700, so that both cases can be washed and/or dried at the same time (e.g., washed in the same machine at the same time). In other embodiments, aperture 702 can provide access to the inner shell case so that foam pieces (e.g., foam pieces 210 of FIG. 2) can be added or removed from the inner shell case. In some embodiments, the aperture can include a zipper, Velcro, buttons, or the like. However, embodiments are not so limited, but rather, in various embodiments, no zipper may be utilized. One reason for not having zippered openings is to prevent tears. Sometimes, tears can occur when a case that includes a zipper is repeatedly opened and closed for repeated washings. Further, non-zipper functionality can enhance the feel of the pillow because an elongated zipper across the body of the pillow can be uncomfortable to some users.

Figure 8:
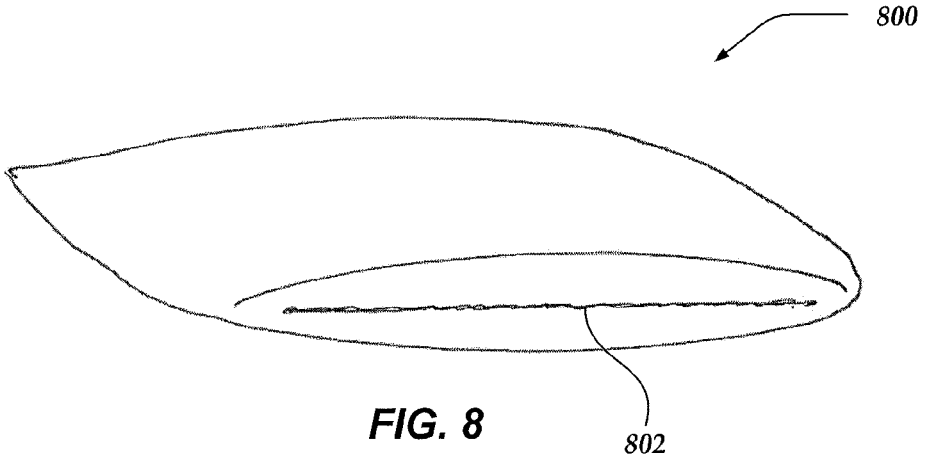
FIG. 8 shows a schematic perspective view of an alternative embodiment of a pillow's outer shell case in accordance with at least one of the various embodiments.

FIG. 8 shows a schematic perspective view of an alternative embodiment of a pillow's outer shell case in accordance with at least one of the various embodiments. Outer shell case 800 may be an embodiment of the outer shell case described in FIG. 2. Outer shell case 800 may include aperture 802.

In at least one of the various embodiments, aperture 802 may be a zipper that is positioned longitudinally along at least one edge of pillow 800. In some embodiments, aperture 802 can allow the removal of the inner shell case (e.g., inner shell case 208 of FIG. 2 and/or inner shell case 900 of FIG. 9) from outer shell case 800, so that both cases can be washed and/or dried at the same time (e.g., washed in the same machine at the same time). In other embodiments, aperture 802 can provide access to the inner shell case so that foam pieces (e.g., foam pieces 210 of FIG. 2) can be added or removed from the inner shell case. In some embodiments, the aperture can include a zipper, Velcro, buttons, or the like.

In some embodiments, outer shell case 800 may include a top and bottom face. Both the top and bottom face may each comprise an external layer (such as external layer 202 of FIG. 2), a foam backing (such as backing layer 204 of FIG. 2), and an internal layer (such as internal layer 206 of FIG. 2). In some embodiments, the internal layer and the external layer may comprise a same material. In other embodiments, the internal layer may comprise a different material, such as a mesh material.

FIG. 9 shows a schematic perspective view of an embodiment of a pillow's inner shell case filled with foam pieces without the outer shell case in accordance with at least one of the various embodiments. Inner shell case 900 may be an embodiment of inner shell case 208 of FIG. 2. In some embodiments, inner shell case 900 may include aperture 902, which may be a zipper or other access mechanism to the inside of inner shell case 900. In various embodiments, aperture 902 may be positioned at an end of inner shell case 900 so as to not interfere with use of the pillow.

Figure 10:
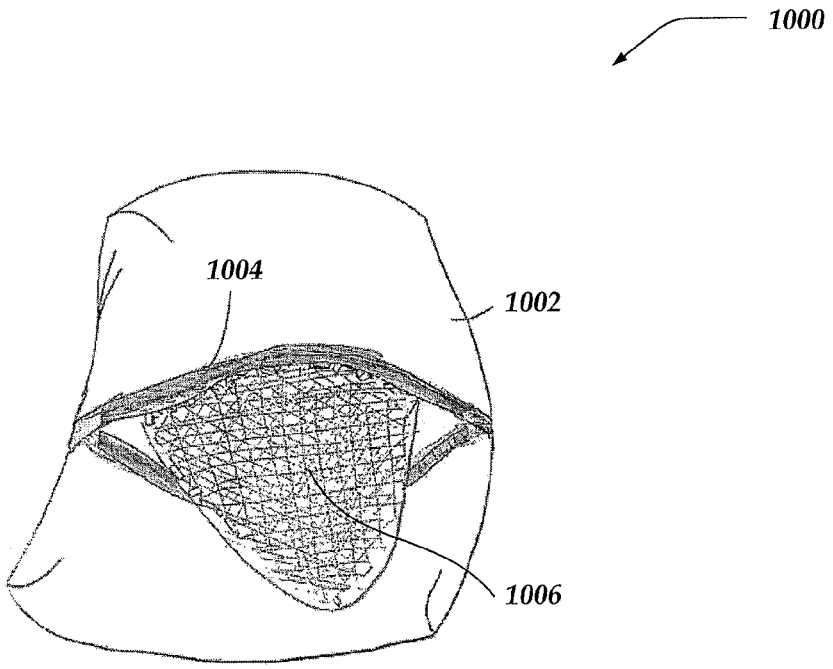
FIG. 10 shows a schematic top view of an embodiment of a pillow with an inner shell case partially removed from an outer shell case in accordance with at least one of the various embodiments.

Inner shell case 900 may be substantially the same shape and size as the outer shell case (e.g., outer shell case 700 of FIG. 7 or outer shell case 800 of FIG. 8) but that inner shell case 900 can fit within the outer shell case. In at least one of various embodiments, inner shell case 700 may be referred to as a removable core of the pillow, which is illustrated in FIG. 10. The inner core may be constructed to include an open fabric and various loose pieces of foam material such that it can be easily washed and dried, as described herein.

FIG. 10 shows a schematic top view of an embodiment of a pillow with an inner shell case partially removed from an outer shell case in accordance with at least one of the various embodiments. Pillow 1000 may be an embodiment of pillow 200 of FIG. 2. As illustrated inner shell case 1006 may be partially removed from outer shell case 1002 through aperture 1004. In some embodiments, inner shell case 1006 may be completely removed from outer shell case 1002 and both may be washed independent, apart, and/or separate from one another.

Figure 11:
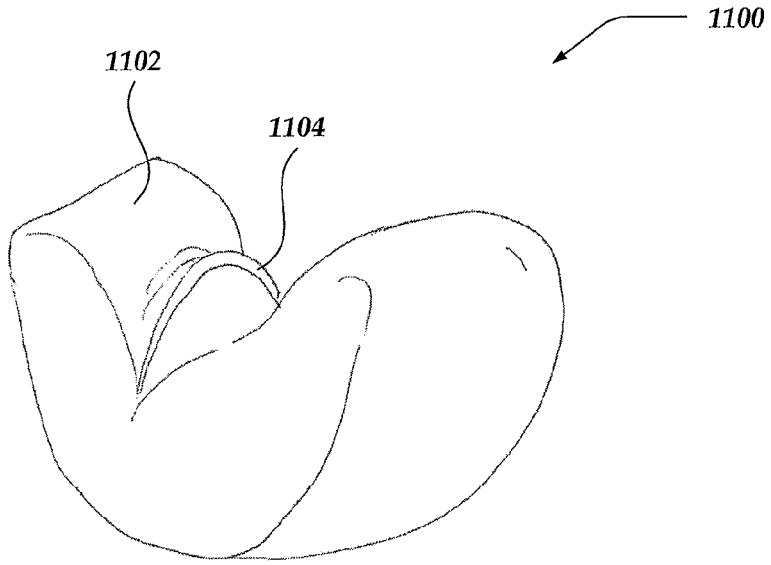
FIG. 11 shows a schematic perspective view of an embodiment of a pillow in a flexed position in accordance with at least one of the various embodiments.

FIG. 11 shows a schematic perspective view of an embodiment of a pillow in a flexed position in accordance with at least one of the various embodiments. Pillow 1100 may be an embodiment of pillow 200 of FIG. 2. As illustrated, aperture 1104 may flex with outer shell case 1102.

Figure 12A:
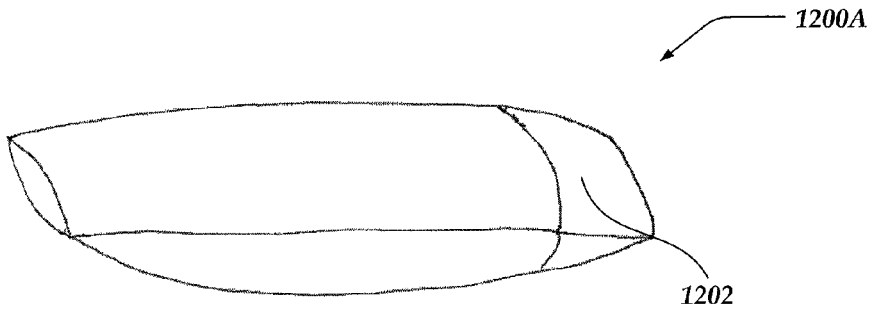
FIGS. 12A-12C show schematic perspective views of an embodiment of a pillow with an outer shell case with a folding flap in accordance with at least one of the various embodiments.
Figure 12B:
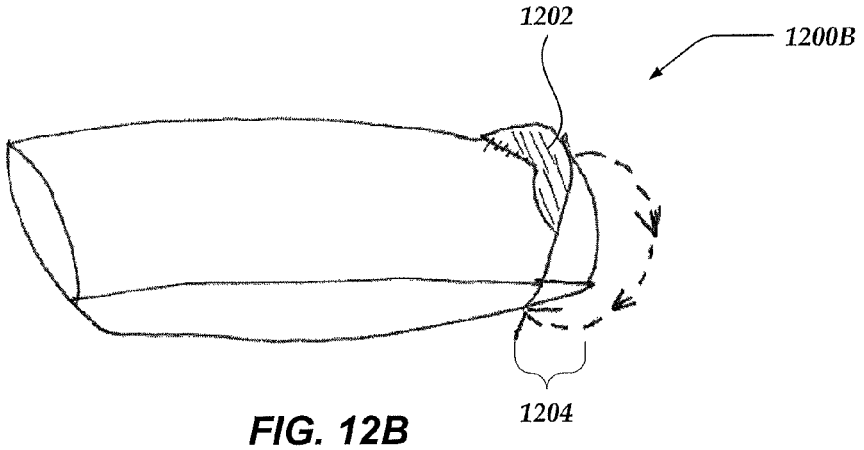
Figure 12C:
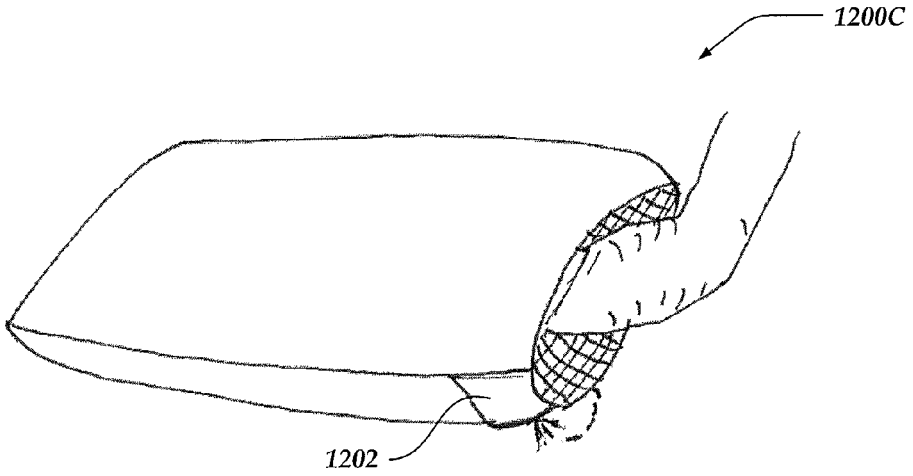

FIGS. 12A-12C show schematic perspective views of an embodiment of a pillow with an outer shell case with a folding flap in accordance with at least one of the various embodiments. In various embodiments, outer shell case 1200 (illustrated by outer shell case 1200A, 1200B, and 1200C) may include flap 1202. Flap 1202 may be near one end of outer shell case 1200. Flap 1202 may be stitched longitudinally along opposing sides of the case such that the flap overlaps the outer shell case by length 1204. Length 1204 may vary but may be at least long enough so as to prevent an inner shell case from sliding out of the outer shell case without assistance by a user. Flap 1202 may fold over the end of the outer shell case to open, as depicted by the dashed arrow in FIG. 12B. Once the flap is open, a user may remove the inner shell case, as illustrated by FIG. 12C.

Figure 13:
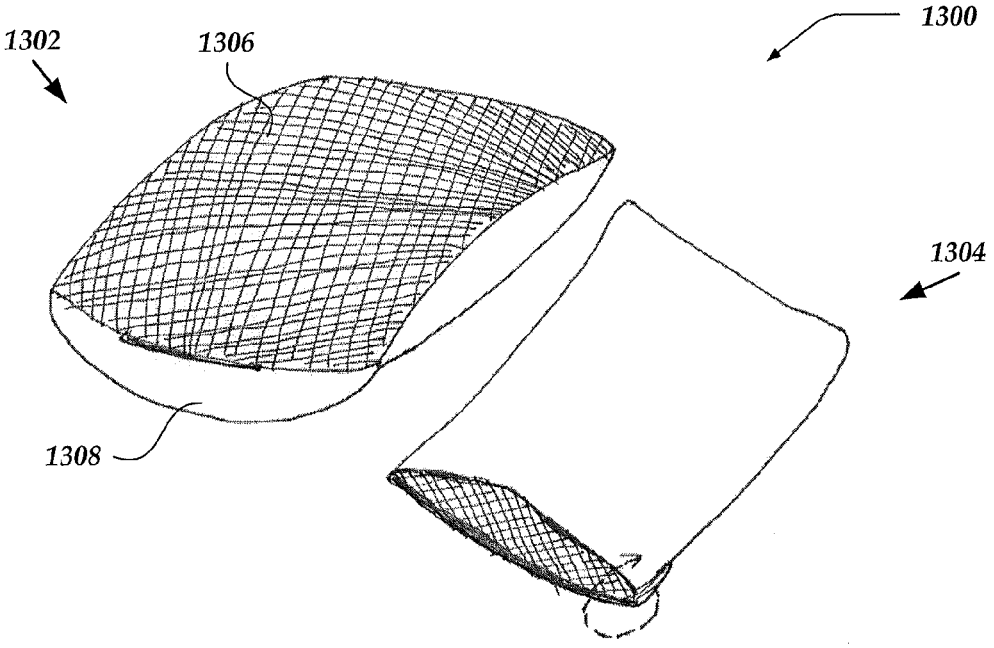
FIG. 13 shows a schematic perspective view of an embodiment of an inner shell case and an outer shell case in accordance with at least one of the various embodiments.

FIG. 13 shows a schematic perspective view of an embodiment of an inner shell case and an outer shell case in accordance with at least one of the various embodiments. Pillow 1300 may include inner shell case 1302 (also referred to as the pillow core) and outer shell case 1304. In some embodiments, inner shell case 1302 may include a mesh face 1306 opposite and opposing non-mesh face 1308. In some embodiments, mesh face 1306 may be a mesh material, as described herein, which may include, but is not limited to, nylon, polyester, or similar material. In at least one of various embodiments, the mesh material may include a plurality of holes. In some embodiments, these holes may be greater than a size of most cotton sheets, but not large enough that foam pieces can fall completely through. In various embodiments, non-mesh face 1308 may be nylon, polyester, water resistant fabric, or other fabric. As described herein, inner shell case 1302 may include a plurality of loose foam pieces. In at least one embodiment, the non-mesh face 1308 may include a foam backing on the interior side of the face.

Outer shell case 1304 may be an embodiment of the outer shell case described in FIG. 2, which may include an external layer (e.g., nylon, polyester, water resistant fabric, or the like), an internal layer (e.g., an open mesh fabric), and a foam sheet disposed between the internal and external layer, as described herein. In various embodiments, the internal layer may include two internal faces, one which may be an open mesh material and the other may be a non-open mesh material (e.g., cotton, polyester, or other suitable material), where the two internal faces may be opposite and towards each other on the interior of outer shell case 1304. In at least one of various embodiments, the internal face with the non-open mesh material may be backed with a foam layer, but the internal face with the open mesh material may not have a foam backing layer.

In various embodiments, inner shell case 1302 may be inserted into outer shell case 1304, such that mesh face 1306 aligns with a mesh internal face of outer shell case 1304 (both of these mesh faces may comprise the same material or different materials). This arrangement may enable a foam backing of outer shell case 1304 to be opposite of a foam backing of inner shell 1302 (which is illustrated in FIG. 16, so that a user would feel the foam backing (rather than the foam pieces inside the inner shell case).

Figure 14:
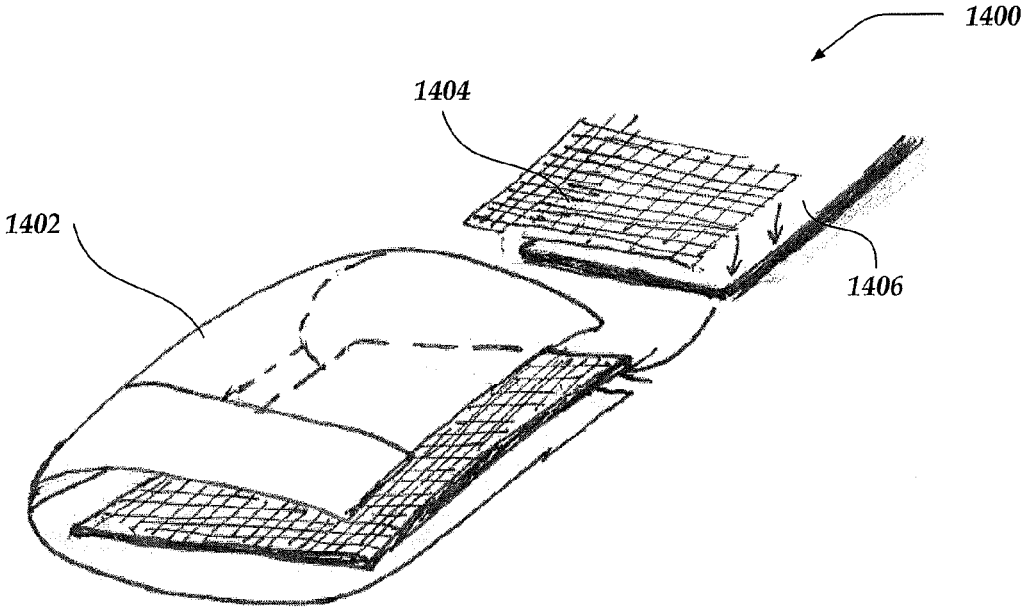
FIG. 14 shows a schematic partial exploded view of an embodiment of an outer shell case in accordance with at least one of the various embodiments.

FIG. 14 shows a schematic partial exploded view of an embodiment of an outer shell case in accordance with at least one of the various embodiments. Outer shell case 1400 may be an embodiment of outer shell case 1304 of FIG. 13. As illustrated, a mesh internal layer may be attached to a backing layer 1406 (e.g., these layers may be stitched together). In some embodiments, mesh internal layer may be an embodiment of internal layer 206 of FIG. 2 and backing layer 1406 may be an embodiment of backing layer 204 of FIG. 2. The combined layer 1404 and layer 1406 may be sewn into one side (or face) of external layer 1402, which may enable the inner shell case (or core) to slip into outer shell case 1400. In yet other embodiments, the combined layer 1404 and layer 1406 may extend across both faces of external layer 1402, rather than just one face. In some embodiments, external layer 1402 may be an embodiment of external layer 202 of FIG. 2.

Figure 15:
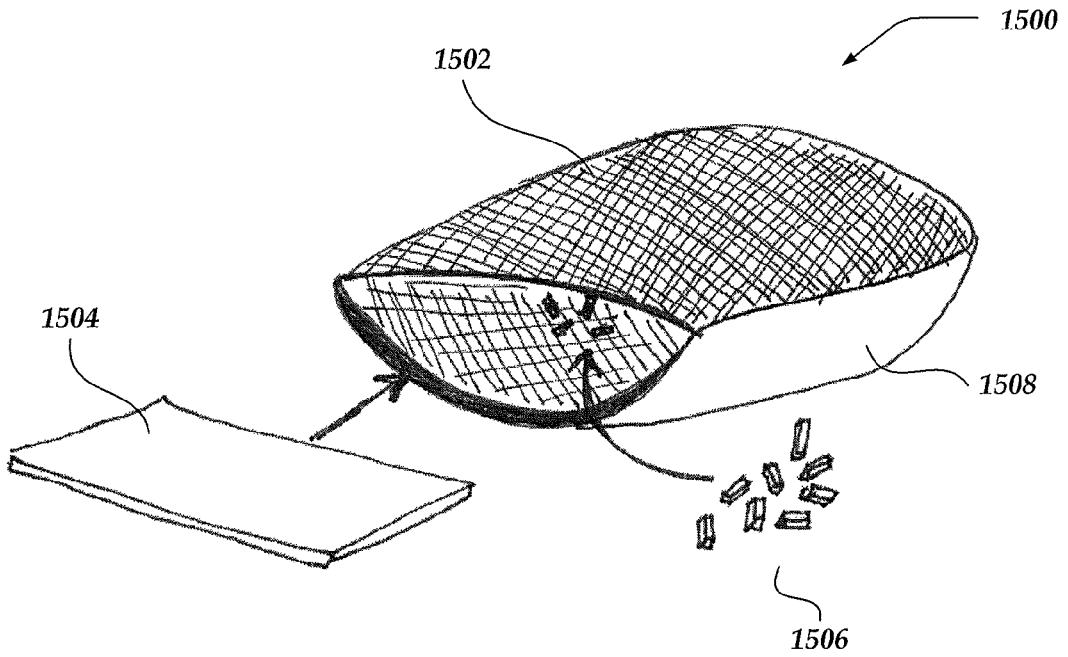
FIG. 15 shows a schematic cut-away view of an embodiment of an inner shell case in accordance with at least one of the various embodiments.

FIG. 15 shows a schematic cut-away view of an embodiment of an inner shell case in accordance with at least one of the various embodiments. Inner shell case 1500 may include a mesh case 1502, a foam backing layer (illustrated by foam sheet 1504), a non-mesh layer 1508, and a plurality of foam pieces 1506. In some embodiments, foam sheet 1504 may be attached to non-mesh layer 1508, and the combination may be affixed (e.g., sewn) to one face of mesh case 1502.

Figure 16:
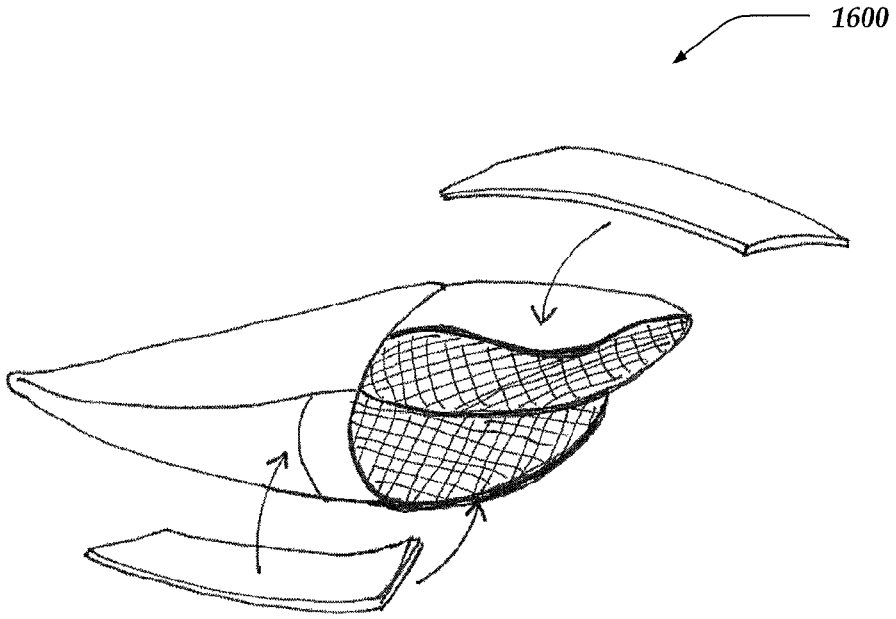
FIG. 16 shows a schematic perspective view of an embodiment of an inner shell case partially removed from an outer shell case in accordance with at least one of the various embodiments.
Figure 17A:
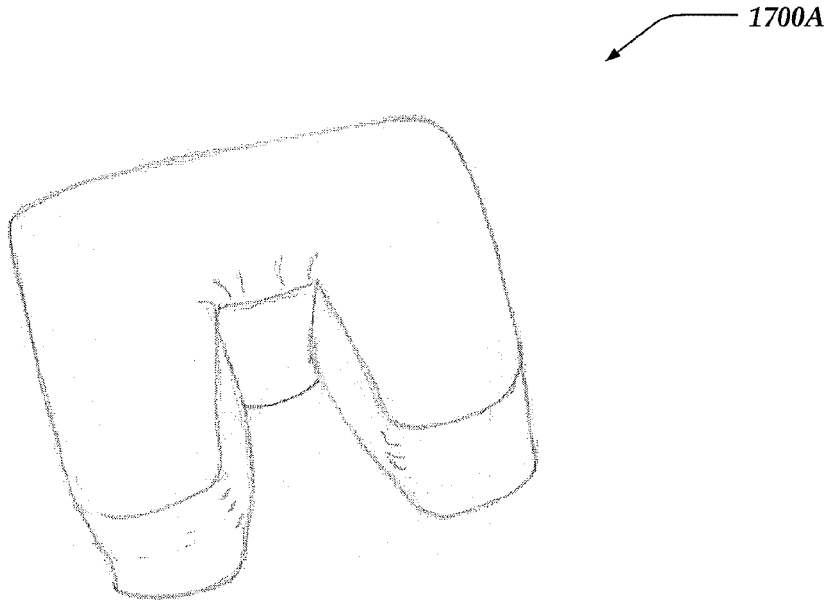
FIG. 17A shows a schematic perspective view of an embodiment of a neck pillow in accordance with at least one of the various embodiments.
Figure 17B:
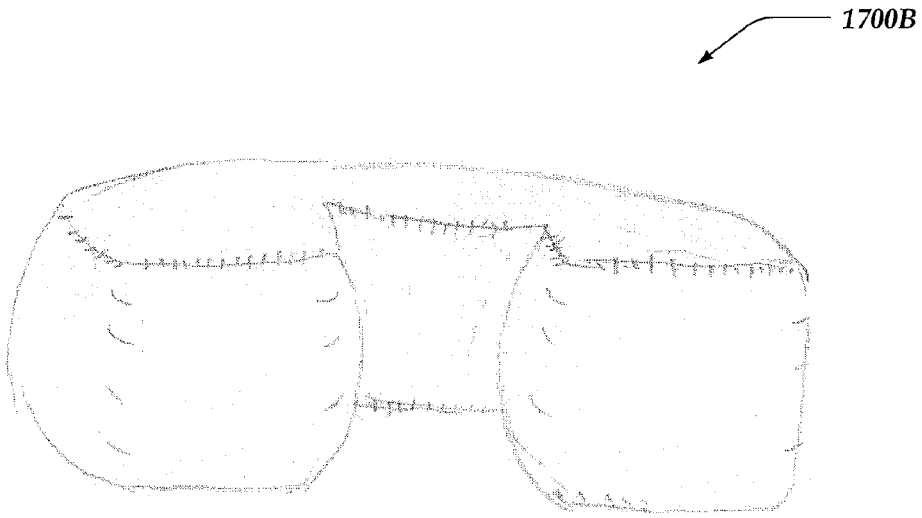
FIG. 17B shows a schematic front-perspective view of an embodiment of a neck pillow in accordance with at least one of the various embodiments.
Figure 17C:
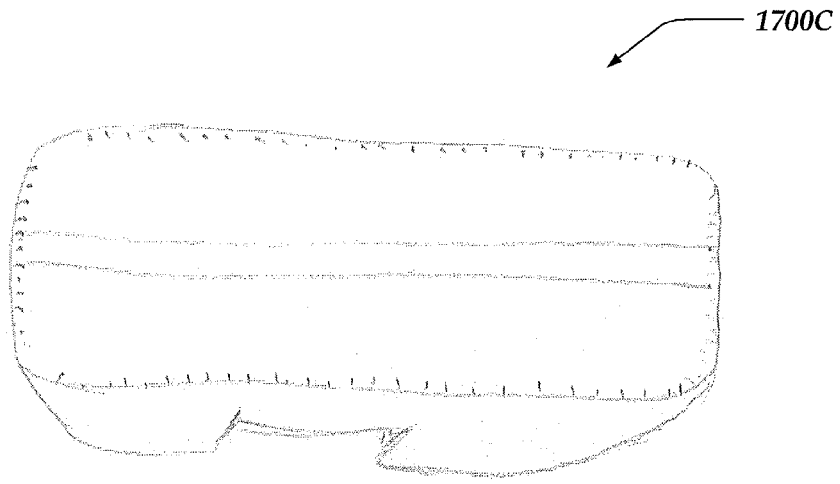
FIG. 17C shows a schematic back-perspective view of an embodiment of a neck pillow in accordance with at least one of the various embodiments.
Figure 17D:
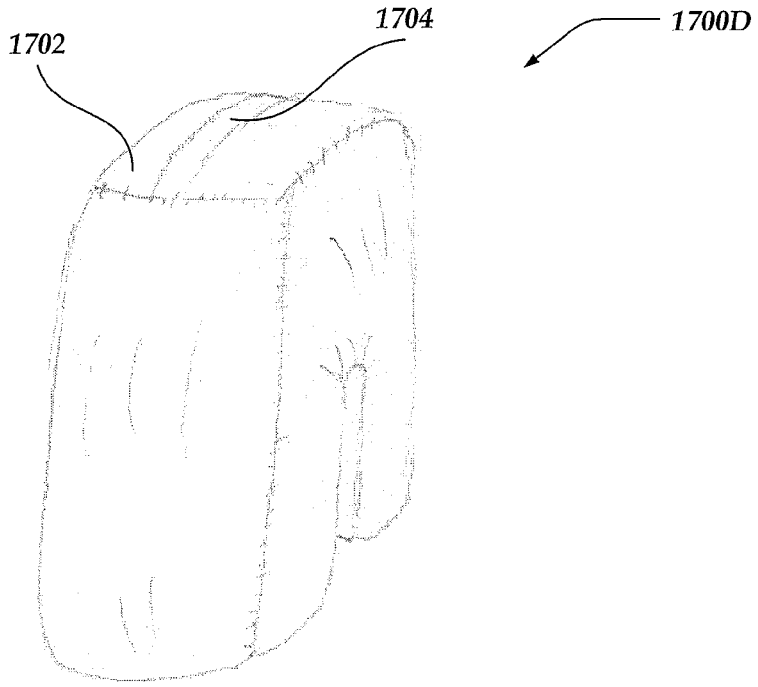
FIG. 17D shows a schematic side-perspective (left or right) view of an embodiment of a neck pillow in accordance with at least one of the various embodiments.

FIG. 16 shows a schematic perspective view of an embodiment of an inner shell case partially removed from an outer shell case in accordance with at least one of the various embodiments. In various embodiments, pillow 1600 may include an inner shell case and an outer shell case (as described herein), where each case may include a foam backing layer affixed to a single face of a corresponding case, such that the foam backing layers are affixed to opposing faces, as illustrated in the figure.

Alternative Embodiments

FIGS. 17A-17D show various schematic perspective views of an embodiment of a neck pillow in accordance with at least one of the various embodiments. By employing embodiments described herein, pillow 1700 (illustrated as pillow 1700A, 1700B, 1700C, and 1700D) may be an embodiment of pillow 200 of FIG. 2 but in a shape that can at least partially surround a user's neck to provide head support, even if the user is not lying down. In some of the various embodiments, pillow 1700 may include embodiments of the pillow described in conjunction with FIGS. 1-10 and as further described in more detail below in conjunction with FIGS. 18A-18D.

FIGS. 18A-18D show various schematic perspective views of an embodiment of a neck pillow with multiple interior cores in accordance with at least one of the various embodiments. In some embodiments, pillow 1800 (illustrated as pillow 1800A, 1800B, 1800C, and 1800D) may be an embodiment of pillow 1700 of FIGS. 17A-17D. As illustrated, pillow 1800 may include outer shell case 1806 and a plurality of inner shell cases, including inner shell cases 1802 and 1804. In some embodiments, outer shell case 1806 may be an embodiment of the outer shell case described in conjunction with FIG. 2. Outer shell case 1806 may include a first sleeve 1820, a second sleeve 1822, and a bridge 1824, which together forms a u-shape. In some embodiments, bridge 1824 may be connect a first end of first sleeve 1820 to a first end of second sleeve 1822, as illustrated in the figures.

In various embodiments, inner shell cases 1802 and 1804 may be embodiments of inner shell case 208 of FIG. 2 with a plurality of foam pieces disposed therein as described herein. Inner shell cases 1802 and 1804 may be formed into cylindrical/elongated shapes and arranged inside outer shell case 1806 such that a first end of each inner shell case is positioned into a separate sleeve, and a second end of each inner shell case extends into bridge 1824. In some embodiments, one of the inner shell cases (e.g., inner shell case 1804) may be longer than the other inner shell case and may be flexed across the bridge to abut the other (shorter) inner shell case, as illustrated in the figures.

In some embodiments, inner shell cases 1802 and 1804 may be rolled up or otherwise form fit to provide the desired elongation to snugly fit inside sleeves 1820 and 1822. In various embodiments, a rolled up case may include a case that is partially folded or one that creates a cylindrical form. So, in some embodiments, inner shell cases 1804 and 1802 may have an approximate diameter (noting that dimensions may be based on the material selected and/or the dimensions of outer shell case 1806) equal to 1808 and 1812.

In various embodiments, inner shell case 1804 may be longer than inner shell case 1802. For example, a length of inner shell case 1804 may be equal to the sum of length 1814 and 1816—where length 1814 may be equal to length 1810—and a length of inner shell case 1802 may be equal to 1816. It should be recognized that the lengths of inner shell case 1804 and 1802 may vary depending on material selection and/or size/dimensions of outer shell case 1806, and may be selected such that the inner shell cases fit snuggly into outer shell case 1806.

Figure 18A:
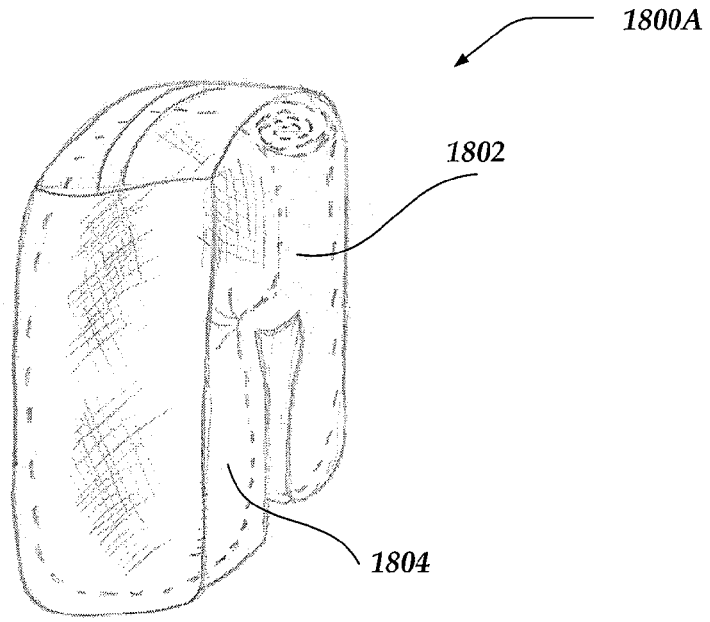
FIGS. 18A-18D show schematic perspective views of an embodiment of a neck pillow with multiple interior cores in accordance with at least one of the various embodiments.
Figure 18B:
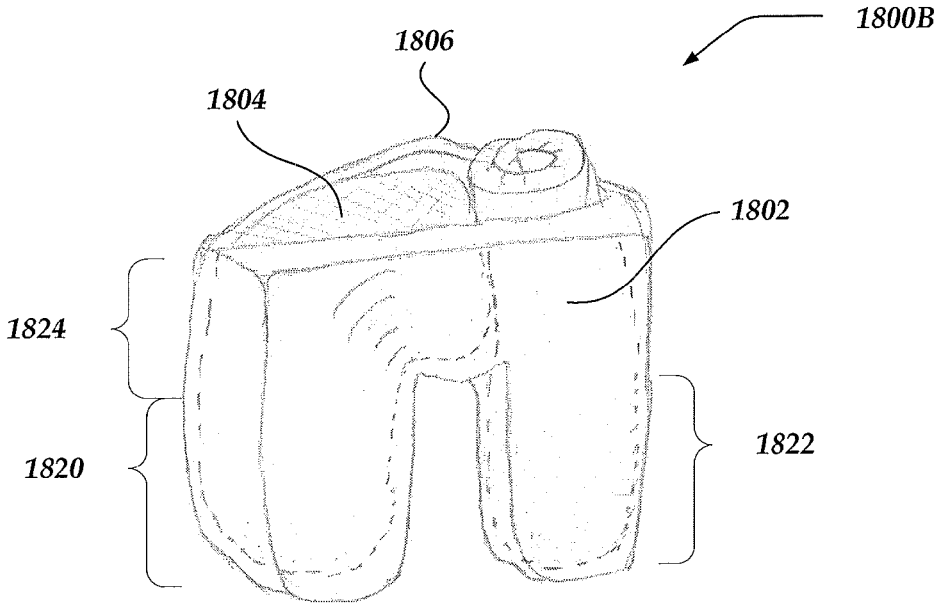
Figure 18C:
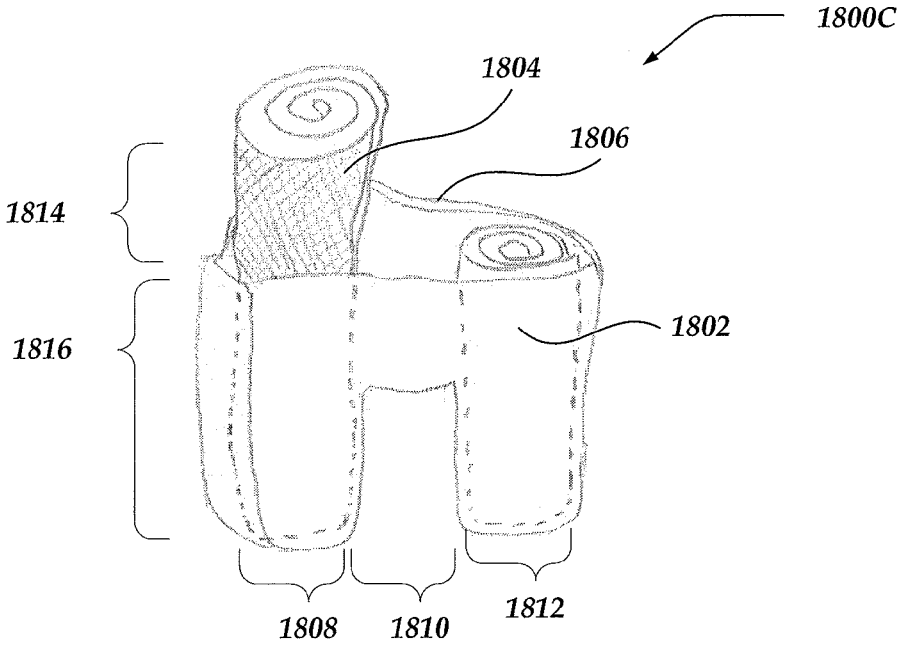
Figure 18D:
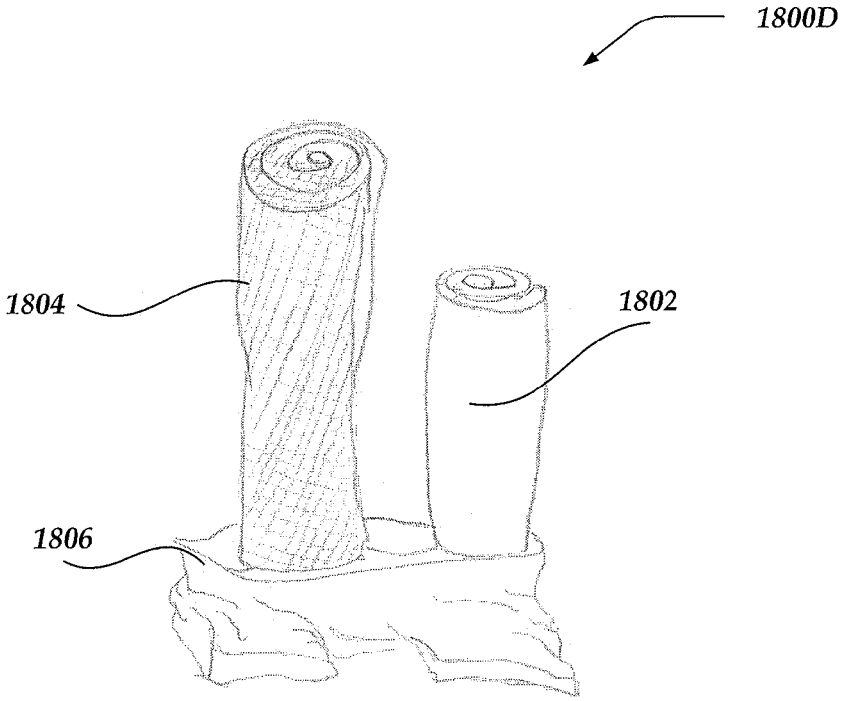

In at least one of various embodiments, inner shell case 1802 may fit one end into sleeve 1822 and the other end may fit into outer shell case 1806 with little or no bending or flexing. Inner shell case 1804 may be fit one end into sleeve 1820 and the other end may be flexed so it abuts a side of inner shell case 1802 (such as illustrated in FIG. 18B).

In various embodiments, inner shell case 1804 and 1802 may be removed from outer shell case 1806 and each case may be washed/cleaned independent of each other.

In some other embodiments, each of inner shell case 1804 and 1802 may be complete pillows as described in FIG. 2, and outer shell case 1806 may be an additional case (e.g., a water resistant case) used for added comfort and support.

Figure 19:
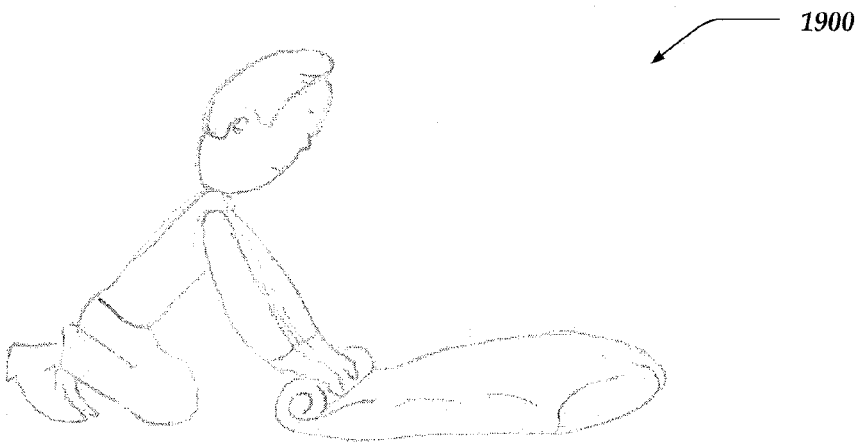
FIG. 19 shows a schematic perspective view of an embodiment of a user rolling up a pillow or inner shell case in accordance with at least one of the various embodiments.
Figure 20:
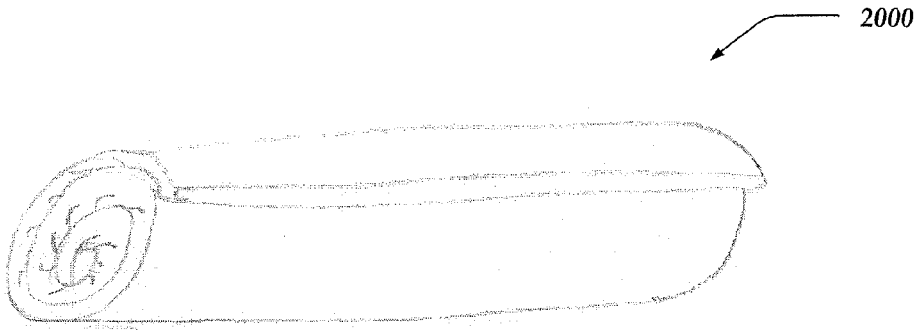
FIG. 20 shows a schematic perspective view of an embodiment of an inner shell case (or pillow) that is rolled up in accordance with at least one of the various embodiments.

FIG. 19 shows a schematic perspective view of an embodiment of a user rolling up a pillow or inner shell case in accordance with at least one of the various embodiments. In some embodiments, a user may roll up two separate inner shell cases (e.g., inner shell cases 1802 and 1804 of FIGS. 18A-18D) to be insert into an outer shell case (e.g., outer shell case 1806 of FIGS. 18A-18D). An illustration of such a rolled up case is shown in FIG. 20. In other embodiments, the user may roll up a pillow and insert the pillow into a carrying case, such as illustrated in FIGS. 21 and 22.

FIG. 20 shows a schematic perspective view of an embodiment of an inner shell case (or pillow) that is rolled up in accordance with at least one of the various embodiments.

Figure 21:
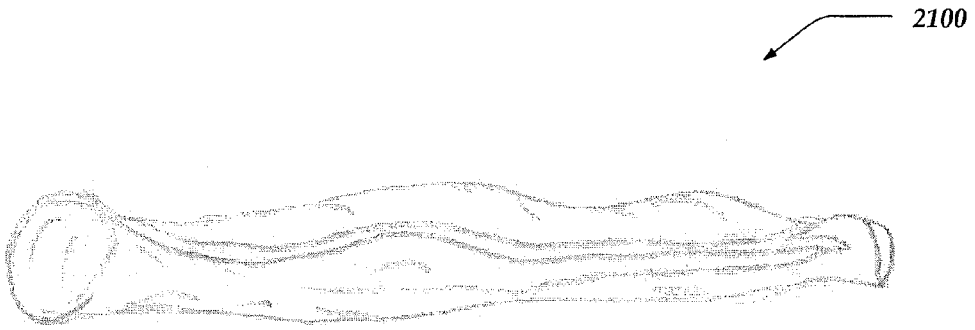
FIG. 21 shows a schematic perspective view of an embodiment of an outer shell case and/or protective carrying case in accordance with at least one of the various embodiments.

FIG. 21 shows a schematic perspective view of an embodiment of an outer shell case and/or protective carrying case in accordance with at least one of the various embodiments.

Figure 22A:
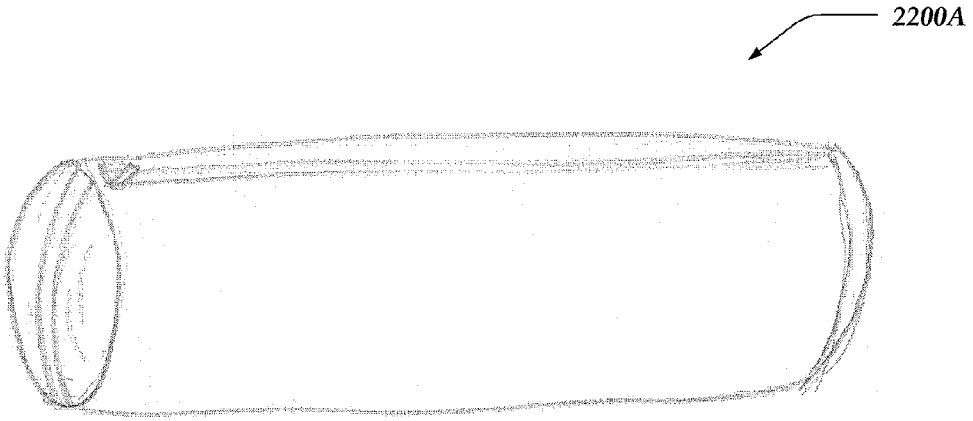
FIGS. 22A-22B show schematic perspective views of an embodiment of a pillow with a protective carrying case in accordance with at least one of the various embodiments.
Figure 22B:
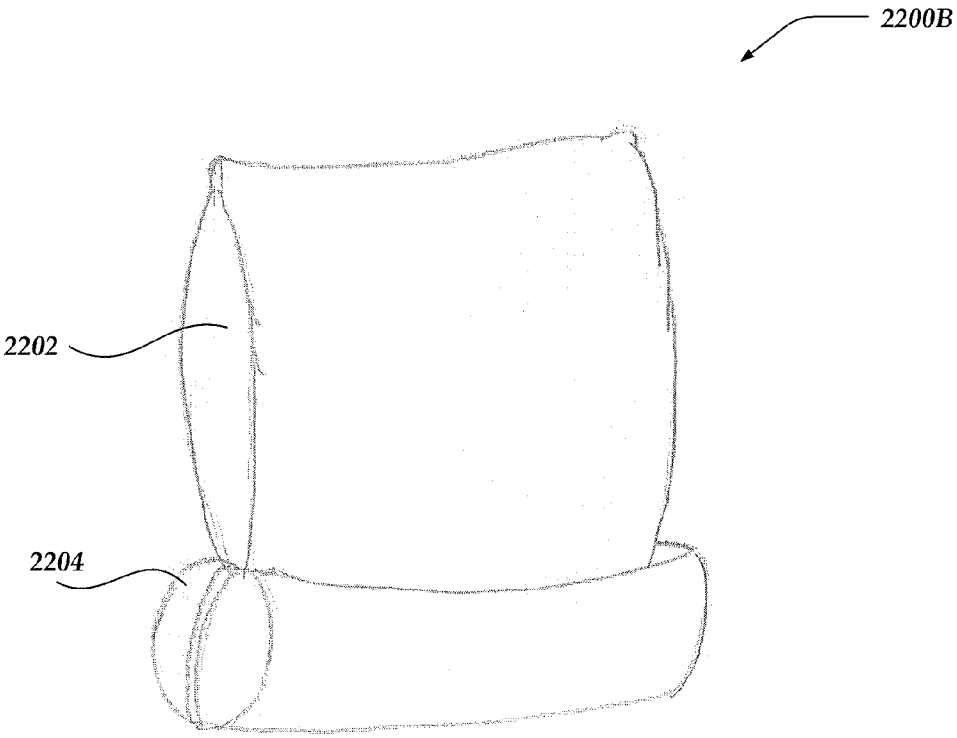

FIGS. 22A-22B show schematic perspective views of an embodiment of a pillow with a protective carrying case in accordance with at least one of the various embodiments. FIG. 22A illustrates the pillow (e.g., pillow 200 of FIG. 2) rolled up and inserted into a carrying case. Although described as being rolled up, embodiments are not so limited and other methods of compacting and/or packing the pillow into a carrying case may be employed. FIG. 22B illustrates pillow 2202 (pillow 2202 may be an embodiment of pillow 200 of FIG. 2) being partially inserted into (or removed from) protective carrying case 2204. In some embodiments, protective carrying case 2204 may be water resistant and/or water proof so that entire pillow 2202 can fit into the carrying case. In some embodiments, pillow 2202 may be connected to carrying case 2204, such as by stitching one edge of pillow 2202 into an inside wall of carrying case 2204.

Figure 23A:
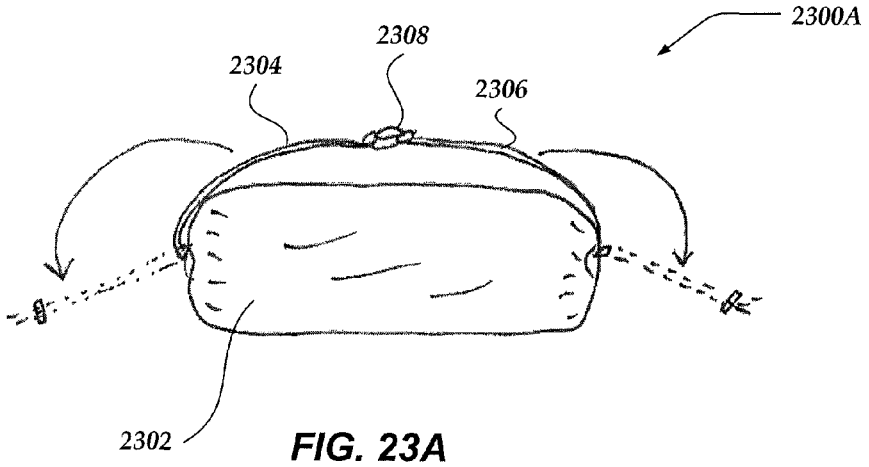
FIGS. 23A-23C show schematic perspective views of an alternative embodiment of a pillow with a protective carrying case in accordance with at least one of the various embodiments.
Figure 23B:
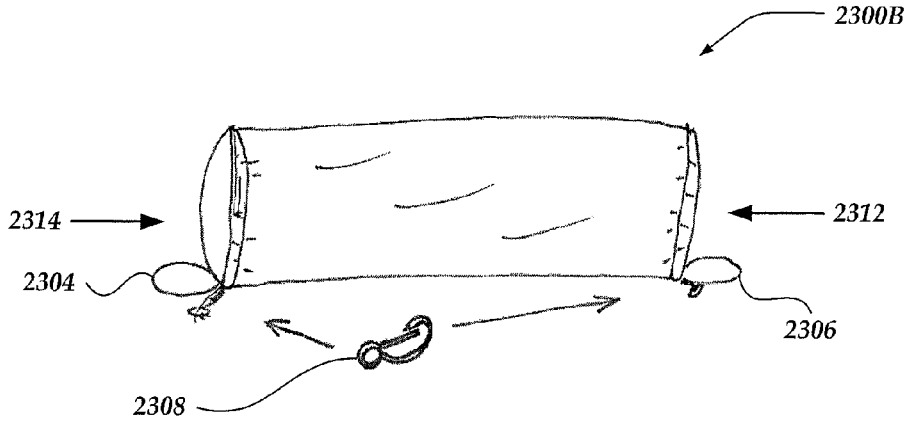
Figure 23C:
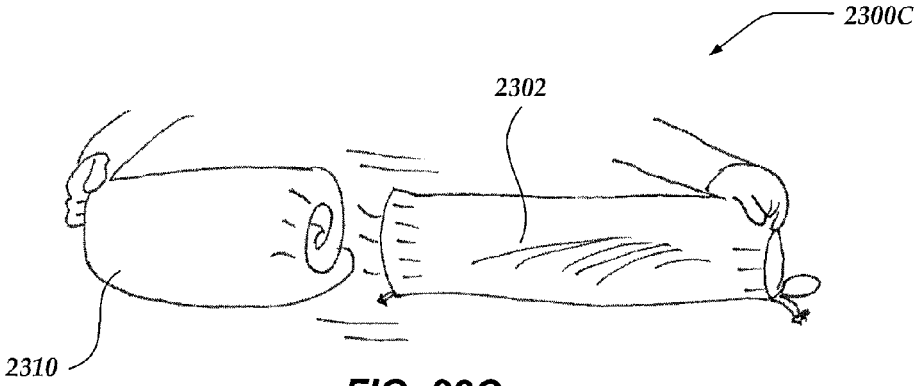

FIGS. 23A-23C show schematic perspective views of an alternative embodiment of a pillow with a protective carrying case in accordance with at least one of the various embodiments. Example 2300 (illustrated in by examples 2300A, 2300B, and 2300C) illustrates protective carrying case 2302 and pillow 2310. In various embodiments, pillow 2310 may be an embodiment of a pillow as described herein with an inner shell case and an outer shell case. In some embodiments, pillow 2310 may have dimensions similar to 45 centimeter by 61 centimeter (or approximately 18 inches by 24 inches), but other dimensions may be used.

In some embodiments, protective carrying case 2302 may be water resistant and/or water proof, or of other suitable material. In at least one of various embodiments, protective carrying case 2302 may be a cylindrical-like shape of suitable size (e.g., a diameter and length suitable to fit pillow 2310, when rolled up). Protective carrying case 2302 may include two open ends that oppose each other, e.g., open ends 2312 and 2314. In some embodiments, protective carrying case 2302 may include one or more drawstring (e.g., drawstrings 2304 and 2306) about each of open ends 2312 and 2314. By extending the drawstring away from the body of the protective carrying case, the corresponding end of the protective case may close. In some embodiments, if both drawstrings 2304 and 2306 are extended, they may be connected by latch 2308. Latch 2308 may be a clip or other suitable releasable attachment mechanism that can enable drawstrings 2304 and 2306 to be removably attached to each other, which may create a carrying strap for the protective case (and the pillow).

In various embodiments, a user may be enabled to insert pillow 2310 into protective carrying case 2302 by rolling the pillow into a cylindrical-like shape (e.g., as illustrated in FIGS. 19 and 20). By having dual open ends in the carrying case, pillow 2310 may maintain its cylindrical form when inserted into protective carrying case 2302. Similarly, air inside the protective carrying case can exit through the end opposing the end the pillow is being inserted into, which can ease insertion and removal of the pillow from the protective carrying case.

Example Foam

Figure 24A:
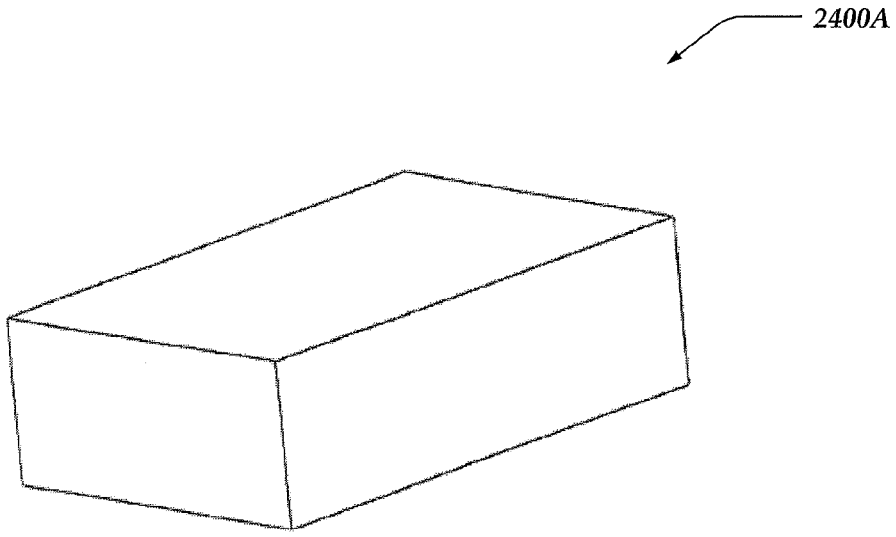
FIGS. 24A-24B show schematic perspective views of various embodiments of a foam block.
Figure 24B:
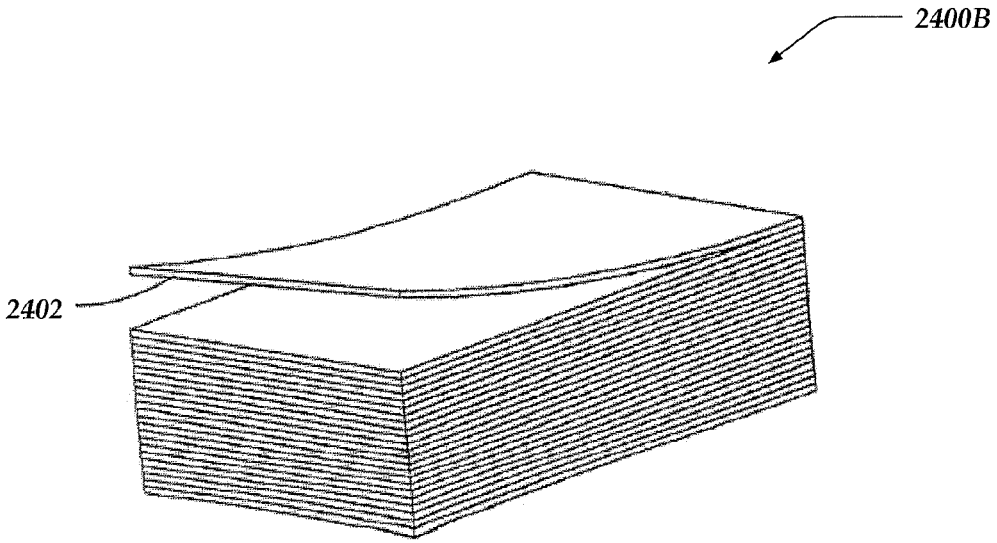

FIG. 24A-24B show schematic perspective views of various embodiments of a foam block that may be utilized in various embodiments. In some embodiments, foam blocks can range in sizes, but can be 4 feet by 2 feet by 8 feet. However, embodiments are not so limited and larger or smaller foam blocks may be used. These foam blocks may be slit or cut into sheets (or foam slices) that can range in size from approximately 2.54 millimeter to 25.4 millimeter (or approximately 0.1 inches to 1 inch). However, embodiments are not so limited and other shapes and/or sizes of foam may be employed. For example, in some other embodiments, the foam may be slit into rolls rather than sheet.

Various foams may be used as the plurality of foam pieces (e.g., foam pieces 210 of FIG. 2) inside the inner shell case (e.g., inner shell case 208 of FIG. 2) or for the backing layer of the outer shell case (e.g., backing layer 204 of FIG. 2). In some embodiments, the foam (e.g., the foam pieces and/or the foam backing) may be made of polyurethane foam or other suitable materials. Various foam cell structures can also be used. For example, in some embodiments, open cell foam be employed; in other embodiments, closed cell foam may be used; and in yet other embodiments, combinations of closed cell foam and open cell foam may be used. Ion some embodiments, reticulated foam may also be used.

The foam utilized in the pillow (e.g., plurality of foam pieces inside the inner shell case or for the backing layer of the outer shell case) may have various material properties including, but are not limited to: a density of from about approximately 16.06 kilograms per cubic meter to about 48.06 kilograms per cubic meter (or approximately 1 pound per cubic foot to about 3 pounds per cubic foot); and/or may have an indent force deflection at 10% to 50% of from about 10 to about 75 pounds; a compressive set percentage between 1 to 30 percent; a tensile strength of approximately 0.3515 to 3.164 kilograms per square centimeter (or approximately 5 to 45 pounds per square inch); a tear strength between approximately 0.294 kilograms per linear centimeter and 3.54 kilograms per linear centimeter (or approximately 0.25 and 3 pounds per linear inch); an elongation percentage of 100 percent or an elongation percentage ranging 90% to 120%; or other the like. Foams having other or additional mechanical properties also fall within the present specification. In various embodiments, foam properties may be established using the ASTM D-3574-86 test method.

Figure 25:
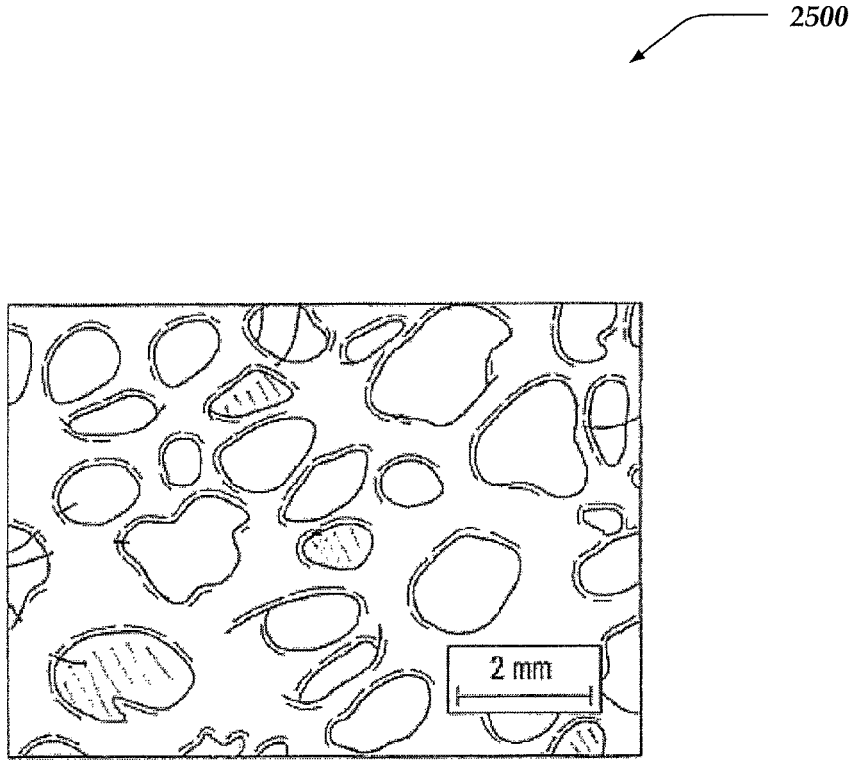
FIG. 25 shows a schematic close-up cross-sectional view of an embodiment of the open cells of foam with a few membranes in some cells in accordance with at least one of the various embodiments.

FIG. 25 shows a schematic close-up cross-sectional view of an embodiment of the open cells of foam with a few membranes in some cells in accordance with at least one of the various embodiments.

FIGS. 26A-26D show schematic perspective views of embodiments of tools for producing foam in accordance with at least one of the various embodiments.

As described herein, the plurality of foam pieces (e.g., foam pieces 210 of FIG. 2) inside the inner shell case may be shaped by various different types of machines and/or processes. For example, in various embodiments, the foam pieces may be precision die cut. In some embodiments, the foam pieces may vary some based on the machine cutting process or variations in a foam cutting machine. For example, assume a foam slice (or a foam panel) is fed into a cutting machine. It may be possible that the first set and/or last set of pieces cut off the foam slice may be shorter or longer than the majority of pieces because of the cutting may not begin at the exact moment the foam slice enters the cutting machine (e.g., misalignment of the start of cutting).

For example, a foam slice or foam block (foam 2602) may be inserted into a die cutting machine. In some embodiments, foam 2602 may be brought to the machine by way of rolls or other methods, rather than individual foam slices. Cutters 2604 may cut foam 2602 into foam pieces 2606, which may drop into container 2610. In some embodiments, foam pieces 2606 may be blown into the inner shell cases. For example, a vacuum may be applied to the machine outlet to collect the cut foam pieces and blow them into the inner shell cases. In some embodiments, a squirrel cage vacuum may be positioned directly into the opening of the inner shell case and blown into the case through an opening approximately 10.16 centimeters to 30.48 centimeters (or approximately 4 inches to 12 inches) wide. This opening may be the entire side of the case if necessary.

Figure 26A:
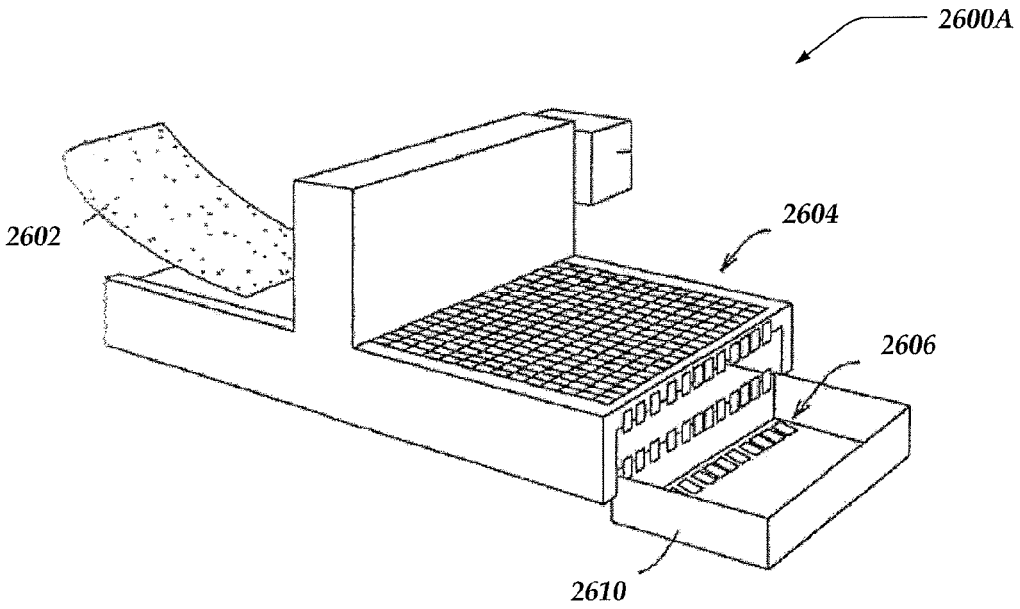
FIGS. 26A-26D show schematic perspective views of embodiments of tools for producing foam in accordance with at least one of the various embodiments.
Figure 26B:
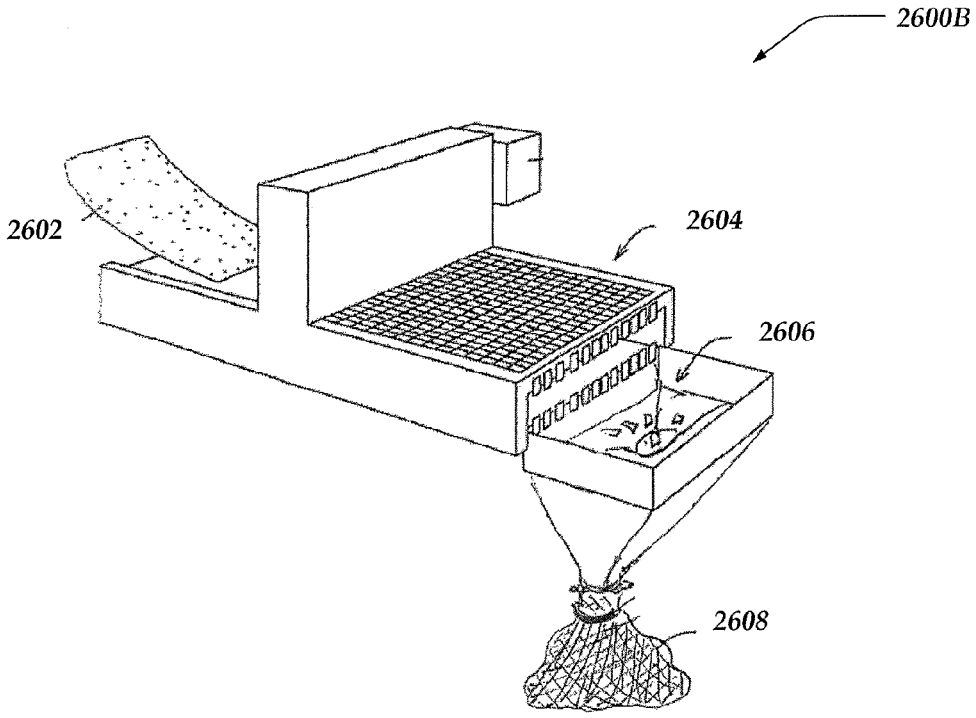
Figure 26C:
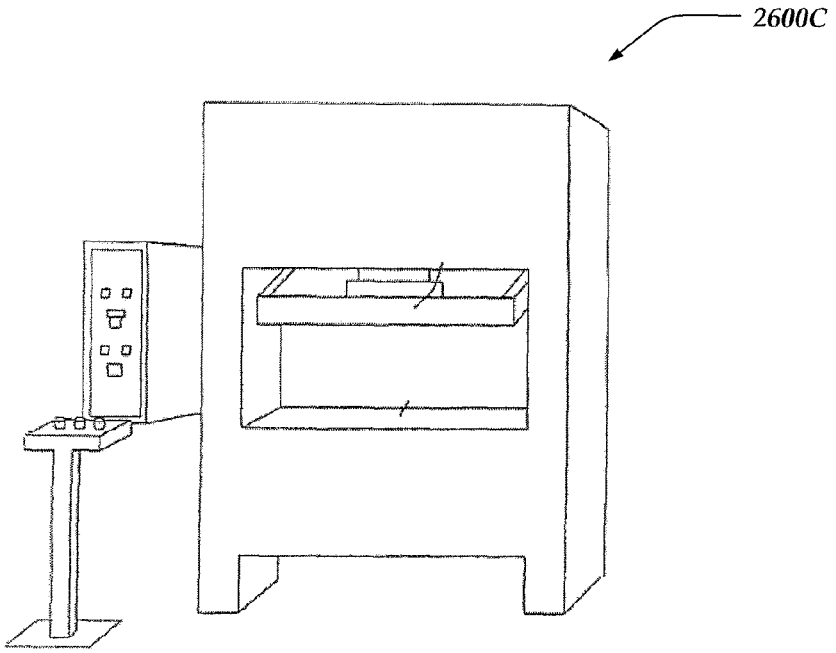
Figure 26D:
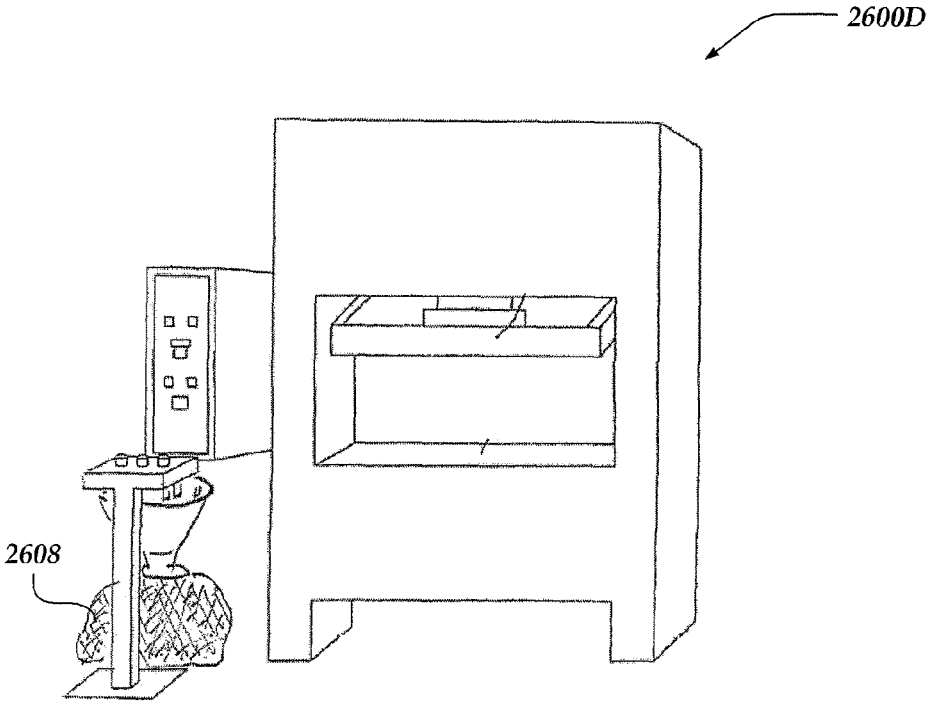

In other embodiments, the foam pieces may be funneled directly into an inner shell case (e.g., case 2608) using a funnel catch at the end of the die cutting assembly line, such as illustrated by of FIG. 26B. In various embodiments, a large open ended funnel can catch the foam pieces coming off the assembly die cut line and feed them directly into the inner shell case attached to the funnel end.

In some embodiments, after the foam pieces are in the inner shell case, the case can be closed by sewing or zipper. In some embodiments, foam pieces may be inserted into an inner shell casing without a zipper and closed by sewing it closed. In other embodiments, foam pieces are inserted into an inner shell case with a zipper and closed by a zippered close. In at least one embodiment, the zipper end/flap/or tag may cut to prevent easy opening of the inner shell case. This zipper flap removal provides adds a layer of safety so that the foam pieces do not accidently fall out. In some embodiments, the zipper may still function, such that a paperclip or other household items may be used to release the zipper if needed (e.g., to add or remove some foam pieces to change the compressibility of the pillow).

In at least one of various embodiments, the tool used (such as illustrated in FIGS. 26A-26D) may be various apparatuses capable of producing foam usable with the present subject matter. However, other processes or machines for producing foam and/or pillows may be employed. In some embodiments, foam blocks of approximately 10.16 centimeters by 5.08 centimeters by 20.32 centimeters (or approximately 4 inches by 2 inches by 8 inches) may be employed. In at least one embodiment, these foam blocks may be slit into sheets (or foam slices) that can range in thickness from approximately 0.254 centimeter to 2.54 centimeters (or approximately 0.1 inches to 1 inch).

Although specific embodiments have been illustrated and described herein, it will be appreciated by those of ordinary skill in the art that any arrangement which is calculated to achieve the same purpose may be substituted for the specific embodiment shown. This application is intended to cover adaptations or variations of the present subject matter. It is to be understood that the above description is intended to be illustrative, and not restrictive. Combinations of the above embodiments, and various embodiments, will be apparent to those of skill in the art upon reviewing the above description.

The above specification, examples, and information provide a complete description of the manufacture and use of the composition of the invention. Since many embodiments can be made without departing from the spirit and scope of the invention, the invention resides in the claims hereinafter appended.

What is claimed is:

1. An apparatus, comprising:

an outer case that includes a first sleeve, a second sleeve, and a bridge that together form a u-shape, the outer case having a plurality of layers, including a backing layer positioned between an external layer and an internal layer, wherein at least the internal layer comprises an open mesh material and the backing layer comprises a foam material;

a first inner case formed into a cylindrical-like shape forming a first end and a second end, the first inner case being removably inserted into the outer case such that the first end of the first inner case is positioned within the first sleeve and the second end of the first inner case extends into the bridge, wherein the first inner case comprises another open mesh material and has a plurality of foam pieces disposed therein;

a second inner case formed into a cylindrical-like shape forming a first end and a second end, the second inner case being removably inserted into the outer case such that the first end of the second inner case is positioned within the second sleeve and the second end of the second inner case is flexed across the bridge and abuts the first inner case, wherein the second inner case comprises yet another open mesh material and has another plurality of foam pieces disposed therein.

2. The apparatus of claim 1, wherein the plurality of foam pieces are sharply cut polyurethane foam.

3. The apparatus of claim 1, wherein the pluralities of foam pieces are of similar size.

4. The apparatus of claim 1, wherein the plurality of foam pieces have a shape of at least one of rectangular or cubic.

5. The apparatus of claim 1, wherein the outer case, the first inner case, and the second inner case are independently washable.

6. An apparatus, comprising:

a protective case that includes a first sleeve, a second sleeve, and a bridge that together form a u-shape;

a first pillow and a second pillow that each include:

an outer case having a plurality of layers, including a backing layer positioned between an external layer and an internal layer, wherein at least the internal layer comprises an open mesh material and the backing layer comprises a foam material;

an inner case that is removably inserted into the outer case, wherein the inner case comprises another open mesh material; and a plurality of foam pieces disposed in the inner case;

wherein the first pillow is rolled into a cylindrical-like shape forming a first end and a second end, the first pillow being removably inserted into the protective case such that the first end of the first pillow is positioned within the first sleeve and the second end of the first pillow extends into the bridge; and wherein the second pillow is rolled into a cylindrical-like shape forming a first end and a second end, the pillow being removably inserted into the protective case such that the first end of the second pillow is positioned within the second sleeve and the second end of the second pillow is flexed across the bridge and abuts the first pillow.

7. The apparatus of claim 6, wherein the plurality of foam pieces are sharply cut polyurethane foam.

8. The apparatus of claim 6, wherein the pluralities of foam pieces are of similar size.

9. The apparatus of claim 6, wherein the plurality of foam pieces have a shape of at least one of rectangular or cubic.

10. The apparatus of claim 6, wherein the outer case, the first inner case, and the second inner case are independently washable.

11. A method, comprising:

generating a first pillow and a second pillow by:

generating an inner case from open mesh material;

filling the inner case with a plurality of foam pieces;

generating an outer case that includes an internal layer that comprises an open mesh material, a backing layer that comprise a foam material, and an external layer, wherein the backing layer is positioned between the external layer and the internal layer; and inserting the inner case into the outer case;

rolling the first pillow and the second pillow into cylindrical-like shapes that each have a first end and a second end, wherein the second pillow is longer than the first pillow;

inserting the first end of the first pillow into a first sleeve of a protective case such that the second end of the first pillow extends into a bridge of the protective case, wherein the protective case includes the first sleeve, a second sleeve, and the bridge that together form a u-shape;

inserting the first end of the second pillow into the second sleeve; and flexing the second end of the second pillow across the bridge to abut the first pillow.

* * * * *